US009803603B2

(12) United States Patent
Ganser

(10) Patent No.: US 9,803,603 B2
(45) Date of Patent: Oct. 31, 2017

(54) DEVICE FOR INJECTING FUEL INTO THE COMBUSTION CHAMBER OF AN INTERNAL COMBUSTION ENGINE

(71) Applicant: Ganser-Hydromag AG, Oberageri (CH)

(72) Inventor: Marco Ganser, Oberageri (CH)

(73) Assignee: GANSER-HYDROMAG AG (CH)

( * ) Notice: Subject to any disclaimer, the term of this patent is extended or adjusted under 35 U.S.C. 154(b) by 307 days.

(21) Appl. No.: 14/767,653

(22) PCT Filed: Feb. 19, 2014

(86) PCT No.: PCT/EP2014/000447
§ 371 (c)(1),
(2) Date: Aug. 13, 2015

(87) PCT Pub. No.: WO2014/131497
PCT Pub. Date: Sep. 4, 2014

(65) Prior Publication Data

US 2016/0010609 A1 Jan. 14, 2016

(30) Foreign Application Priority Data

Mar. 1, 2013 (CH) ..... 534/13

(51) Int. Cl.
*F02M 61/04* (2006.01)
*F02M 47/02* (2006.01)
(Continued)

(52) U.S. Cl.
CPC ..... *F02M 61/04* (2013.01); *F02M 47/027* (2013.01); *F02M 55/005* (2013.01);
(Continued)

(58) Field of Classification Search
CPC .... F02M 55/005; F02M 55/008; F02M 61/04; F02M 61/165; F02M 67/10; F02M 47/027; F02M 2200/28; F02M 2200/40
See application file for complete search history.

(56) References Cited

U.S. PATENT DOCUMENTS 5,655,716 A * 8/1997 Mathis ..... F02M 47/027 239/533.8
6,161,774 A * 12/2000 Ricco ..... F02M 47/027 239/127
(Continued)

FOREIGN PATENT DOCUMENTS

CH 702 496 B1 7/2011
EP 2 188 516 B1 5/2010
(Continued)

OTHER PUBLICATIONS

Notification of Transmittal of Translation of the International Preliminary Report on Patentability and English language translation of the International Preliminary Report on Patentability dated Sep. 11, 2015 in PCT Application No. PCT/EP2014/000447.
(Continued)

*Primary Examiner* — Hieu T Vo
*Assistant Examiner* — Sherman Manley
(74) *Attorney, Agent, or Firm* — Hershkovitz & Associates, PLLC; Abe Hershkovitz

(57) ABSTRACT

The housing (18) of the fuel injection valve (10) of the device for intermittently injecting fuel into the combustion chamber of an internal combustion engine comprises a high-pressure inlet (34) with a conical sealing face (44). The high-pressure chamber (36) is disposed in the housing (18) from the high-pressure inlet (34). A cartridge-like, independent component (56) is inserted into the high-pressure chamber (36). Said component comprises the valve carrier (46), the non-return valve (48), the holding element (50),
(Continued)

and preferably the filter body (52'). The valve carrier (46) is provided with a conical outer sealing face (69), by which the valve carrier rests against the conical sealing face (44). A fixing element (74) presses the supply line (16) against the valve carrier (46).

26 Claims, 13 Drawing Sheets

(51) Int. Cl.
*F02M 55/00* (2006.01)
*F02M 61/16* (2006.01)
*F02M 67/10* (2006.01)

(52) U.S. Cl.
CPC ..... *F02M 55/008* (2013.01); *F02M 61/165* (2013.01); *F02M 67/10* (2013.01); *F02M 2200/28* (2013.01); *F02M 2200/40* (2013.01)

(56) References Cited

U.S. PATENT DOCUMENTS

2001/0009148 A1* 7/2001 Asada ..... F02M 55/005 123/456
2001/0013556 A1* 8/2001 Ganser ..... F02M 47/027 239/88
2001/0050073 A1 12/2001 Engelmeyer et al.
2010/0170476 A1* 7/2010 Ganser ..... F02M 55/025 123/447
2010/0194096 A1* 8/2010 Seifert ..... F16L 27/047 285/24
2011/0271935 A1 11/2011 Pirkl et al.
2013/0298873 A1* 11/2013 Pasedach ..... F02M 63/0003 123/456
2014/0132001 A1* 5/2014 Stahl ..... F16L 19/005 285/390
2014/0360469 A1 12/2014 Ganser

FOREIGN PATENT DOCUMENTS

WO WO 2004/099603 A 11/2004
WO WO 2005/003550 A 1/2005
WO WO 2005/019637 A 3/2005
WO WO 2005/080785 A 9/2005
WO WO 2006/058444 A 6/2006
WO WO 2006/108309 A 10/2006
WO WO 2007/009279 A 1/2007
WO WO 2008/046238 A 4/2008
WO WO 2009/033304 A 3/2009
WO WO 2010/088781 A1 8/2010
WO WO 2013/117311 A 8/2013

OTHER PUBLICATIONS

English language Abstract for EP 2 188 516 B1.
English language Abstract for CH 702 496 B1.
International Search Report dated May 26, 2014 in PCT Application No. PCT/EP2014/000447.
English language translation of the International Search Report dated May 26, 2014 in PCT Application No. PCT/EP2014/000447.
Search Report mailed by EPO dated Apr. 12, 2013 for CH 0534/2013.

* cited by examiner

DEVICE FOR INJECTING FUEL INTO THE COMBUSTION CHAMBER OF AN INTERNAL COMBUSTION ENGINE

BACKGROUND OF THE INVENTION

1. Field of the Invention

The present invention relates to a device for intermittently injecting high-pressure fuel into the combustion chamber of an internal combustion engine.

2. Discussion of Background Information

A device having injection valves for injecting fuel into the combustion chamber of an internal combustion engine is disclosed in the earlier international application WO 2013/117311 A. The injection valves of the device have a valve housing with a connection body, a storage body adjoining the latter and having a discrete storage chamber, an intermediate body, which in turn adjoins the storage body and in which an electrically controlled actuator arrangement is accommodated, and along with a valve body adjoining the intermediate body. At its free end, the valve body carries a nozzle body having an injection valve seat and nozzle openings for injecting the fuel into the combustion chamber of the internal combustion engine. Interacting with the injection valve seat is an injection valve member designed in the form of a needle, which is designed in the form of a piston on the side remote from the injection valve seat. Supported on the injection valve member is a closing spring, which subjects the injection valve member to a closing force directed in a direction toward the injection valve seat. At the other end, the closing spring is supported on a guide sleeve of a hydraulic control device. The piston and the guide sleeve delimit a control chamber, which is connected to a pilot valve actuated by means of the actuator. To trigger an injection process, the pilot valve is opened, allowing fuel to flow out of the control chamber and thereby raising the injection valve member from the injection valve seat, counter to the force of the closing spring. To end the injection process, the pilot valve is closed by means of the actuator arrangement, after which the control chamber refills with fuel and the injection valve member comes to rest on the injection valve seat.

On the connection body there are two fluidically interconnected high-pressure connections of identical design, one of them being used for connection to a feed line for supplying the injection valve with fuel. A connecting line can be connected to the other high-pressure connection in order to supply a further injection valve with fuel.

The storage body has a bore of relatively large diameter in order to form the discrete storage chamber. In an end segment adjacent to the connection body, the blind bore has a relatively large diameter in order to form a shoulder for supporting a valve carrier of a check valve. The check valve seat is formed on the connection body and, interacting with it, there is a check valve body of plate-shaped design which has a central through restriction bore. The check valve body is subjected by means of a closing spring designed as a compression spring, which is supported at the other end on the valve carrier, to a closing force directed toward the closing position of the check valve.

Extending centrally through the valve carrier is a passage, and the valve carrier closes off the storage chamber in an axial direction toward the closing body. The check valve, which forms a restricting device, allows the flow of the fuel from the high-pressure connections into the storage chamber at least approximately unhindered and restricts the flow in the opposite direction. The valve carrier furthermore carries a cup-shaped hole filter, which projects from the valve carrier into the interior of the storage chamber and into which the passage through the valve carrier opens.

Another device for intermittently injecting high-pressure fuel into the combustion chamber of an internal combustion engine is known from document WO 2007/009279 A. Each injection valve of this device is assigned a discrete storage chamber, wherein a check valve with a restrictor connected in parallel acts between the feed line and the storage chamber. If a plurality of such fuel injection valves or a plurality of injection valves of the kind disclosed in the abovementioned CH and WO patent applications are connected to one another and to a high-pressure fuel feed pump, the restricting effect of the check valve is designed in such a way that high-pressure fuel flows to each fuel injection valve from the discrete storage chambers of other fuel injection valves, from the high-pressure fuel lines and from the high-pressure fuel feed pump during an injection process. This mode of operation is described in detail in document WO 2007/009279 A and also in document WO 2009/033304 A.

In the context of the present invention, attention is drawn explicitly to the abovementioned documents as regards the dimensioning of the storage chamber, the action of the check valves and the restricting action.

Moreover, devices for injecting fuel into the combustion chamber of internal combustion engines are known from documents EP 2 188 516 B1 and CH 702 496 B1.

SUMMARY OF THE INVENTION

It is an object of the present invention to develop the device for intermittently injecting high-pressure fuel into the combustion chamber of an internal combustion engine in such a way that it can be produced and assembled more easily.

The device has a fuel injection valve, preferably a plurality of fuel injection valves of identical design, having a housing that has a high-pressure inlet, a recess and a high-pressure space, which is connected to the high-pressure inlet. The recess preferably forms at least part of the high-pressure space. The fuel injection valve is assigned a valve carrier, which has a fuel passage, and a check valve. The check valve is preferably arranged in the valve carrier. A feed line for feeding fuel to the fuel injection valve is loaded in a direction toward the high-pressure inlet by means of a fastening element and fluidically connected to said high-pressure inlet.

The high-pressure inlet has a conical sealing surface, which widens toward the outside from the interior of the housing. In other words, it forms an inner cone. The valve carrier has a conical outer sealing surface on an outer circumferential surface, which sealing surface rests sealingly on the conical sealing surface of the high-pressure inlet. The fastening element presses the feed line against the valve carrier, and presses the latter against the high-pressure inlet.

The valve carrier furthermore preferably has an inner cone at an inlet end, which inner cone likewise forms a sealing surface. In its end region adjacent to the fuel valve, the feed line has an outer cone, which forms a sealing surface which rests sealingly on the inner cone of the valve carrier.

The valve carrier is held as it were clamped between the feed line and the housing. The contact between the valve carrier and the housing, on the one hand, and that between the feed line and the valve carrier, on the other hand, form a high-pressure seal which is achieved by virtue of the fact that the fastening element, e.g. a union nut, loads the feed line in a direction toward the high-pressure inlet.

If the feed line is connected to the fuel injection valve only in situ, it may be advantageous to fix the valve carrier on the housing. However, this fixing need not apply such a force that the valve carrier rests sealingly on the conical sealing surface of the high-pressure inlet, although it may do so.

Preferably, the valve carrier has a funnel-shaped end flange, on which both the conical outer sealing surface and the inner cone are formed. This leads to a space-saving embodiment and allows optimum pressure and stress distribution between the outer cone of the feed line and the conical sealing surface of the high-pressure inlet in the funnel-shaped end flange, thereby making it possible to achieve a reliable high-pressure seal in a simple manner.

The conical sealing surface of the high-pressure inlet is furthermore preferably formed on the housing itself—as a segment of the recess. This leads to a particularly simple and space-saving embodiment.

The sealing effect between the conical sealing surface of the high-pressure inlet and the conical outer sealing surface of the valve carrier, on the one hand, and that between the inner cone of the valve carrier and the outer cone of the feed line, on the other hand, can be achieved in a particularly effective way if there is in each case a cone angle difference of 0.5° to 2°, i.e. if the two interacting cones enclose a corresponding angle which opens outwardly in a radial direction. Annular sealing surfaces are thereby formed in each case at the smallest diameter of the interaction between the corresponding tapers.

The valve carrier is preferably formed as a self-contained, cartridge-type modular unit together with the check valve and a holding element, which is fastened on the valve carrier and preferably has a further fuel passage. This preassembled modular unit can then be inserted as such into the recess or high-pressure space of the housing of the fuel injection valve, or is inserted as such.

This makes it possible to simplify the design of the housing and, in particular, to preassemble the entire fuel injection valve—apart from the modular unit—and only then to mount the modular unit on the housing.

This has the additional advantage that the modular unit can be tested separately as such and, moreover, simple replacement of the check valve is made possible.

In a preferred embodiment, the modular unit has a filter for the fuel, which is preferably carried by the holding element and fastened on the latter.

In this case, the modular unit is formed by the valve carrier, the check valve, the holding element and the filter.

In a preferred embodiment, the filter has a cup-shaped filter body, wherein the further fuel passage opens into the cavity delimited by the filter body.

In particular, the filter body is provided with a large number of microholes, e.g. at least 2000.

An annular check valve seat is preferably formed on the valve carrier, said seat interacting with a check valve member, which is arranged between the valve carrier and the holding element.

As a further preferred option, the check valve member is designed as a valve plate, and the latter is preferably provided centrally with a restrictor passage. The latter is fluidically connected to the fuel passage and thus to the feed line, even when the check valve is closed.

As a further preferred option, a compression spring, which subjects the valve plate to a force acting in the closing direction, preferably acts between the valve plate and the holding element. However, this force is small and merely ensures that the valve plate rests on the check valve seat when the pressure is balanced.

The valve plate preferably has at least one aperture open in a direction radially toward the outside and passing through in the direction of the longitudinal axis—preferably three (or more) such apertures distributed in the circumferential direction. This allows low-resistance, unrestricted flow of the fuel between the valve plate situated in the open position and the valve carrier or holding element surrounding said plate. The aperture or apertures is/are situated radially to the outside of the check valve seat.

In its end region adjacent to the valve plate, the holding element has at least one groove open in a direction toward the valve plate and passing through in a radial direction—preferably three (or more) such grooves distributed in the circumferential direction. This allows flow of the fuel with as little resistance as possible when the check valve is open.

As a particularly preferred option, the high-pressure space in the injection valve has a discrete storage chamber for storing fuel. The design of discrete storage chambers of this kind and the interaction thereof with the check valve and the restriction is described in detail in document WO 2007/009279 A and also in document WO 2009/033304 A. Attention is drawn explicitly to these documents.

The abovementioned modular unit preferably projects into the discrete storage chamber, in particular by means of the filter.

In a preferred embodiment, the housing of the fuel injection valve carries a nozzle body, which is connected to the high-pressure space and on which an injection valve is formed. An injection valve member arranged in such a way as to be adjustable in the direction of the longitudinal axis interacts with said injection valve. A closing spring, preferably designed as a compression spring, is supported on the injection valve member and subjects the latter to a closing force directed in a direction toward the injection valve seat. There is furthermore in the housing a hydraulically controlled control device for the purpose of raising the injection valve member from the injection valve seat against the closing force of the compression spring in order to inject fuel. The hydraulic control device is controlled in a known manner by means of an electrically controlled actuator, likewise arranged in the housing.

The actuator and the hydraulic control device can be designed in any way, in particular in the manner disclosed in the abovementioned Swiss Patent Application No. 2012 0174/12, and in publications WO 2007/009279, WO 2010/088781 A1, WO 2008/046238 A, WO 2006/108309 A, WO 2006/058444 A, WO 2005/080785 A, WO 2005/019637 A, WO 2005/003550 A or WO 2004/099603 A.

In one embodiment, the housing has, on the one hand, a valve housing, which carries the nozzle body and in which the injection valve member, the closing spring, the actuator and the control device are arranged and on which a conical contact pressure surface acting as a sealing surface is formed. It is from this sealing surface that the high-pressure space for the fuel extends in the valve housing. On the other hand, the housing has a pressure connection piece, on the connection piece housing of which the high-pressure inlet is formed and the longitudinal axis of which extends transversely, preferably at right angles, to the longitudinal axis of the valve housing. The connection piece housing has, in an end region remote from the high-pressure inlet, a conical mating contact pressure surface, which likewise forms a sealing surface. The mating contact pressure surface rests sealingly on the contact pressure surface, and the discrete storage chamber or part of the discrete storage chamber, if present, is formed in the connection piece housing. The fuel is fed to the high-pressure space via the pressure connection piece.

In this embodiment too, the valve carrier rests by means of its conical outer sealing surface on the conical sealing surface preferably formed on the pressure connection piece housing. The outer cone of the feed line furthermore preferably rests on the inner cone of the valve carrier, and the feed line is loaded in a direction toward the high-pressure inlet, i.e. toward the connection piece housing, by means of the fastening element.

In connection with the embodiment of the injection valve with a pressure connection piece, reference is made to document WO 2009/033304 A, the disclosure of which is incorporated herein by reference thereto.

The housing or the connection piece housing preferably has a high-pressure outlet, which is arranged next to the high-pressure inlet and is fluidically connected, preferably without restriction or hindrance, to the high-pressure inlet in order to supply a further injection valve with fuel via a high-pressure connecting line connected to the high-pressure outlet. The mode of operation of this embodiment is described in WO 2007/009279 A and also in document WO 2009/033304 A.

The high-pressure outlet preferably has an inner cone, which is formed on the housing or connection piece housing and on which the outer cone of the connecting line rests sealingly.

The valve carrier preferably has, between the inner cone and the check valve, a radial outlet, which starts from the fuel passage and which is fluidically connected to the high-pressure outlet via a connecting line in the housing or the connection piece housing. The feed line is thereby connected with little resistance and without restriction to the connecting line.

The valve carrier together with the housing or the connection piece housing preferably delimits a narrow gap downstream of the radial outlet, as viewed in the direction of flow of the fuel in the injection valve. The high-pressure space or the discrete storage chamber is thereby separated hydraulically from the connecting line, at least for transient processes.

In one embodiment, the device for intermittently injecting high-pressure fuel into the combustion chamber of an internal combustion engine is provided with a fuel injection valve, which has a housing that has a high-pressure inlet, a recess and a high-pressure space, with a valve carrier, which has a fuel passage, with a check valve, which allows flow of the fuel from the high-pressure inlet through the fuel passage into the high-pressure space with as little hindrance as possible and at least restricts said flow in the opposite direction, with a feed line for feeding fuel to the fuel injection valve, and with a fastening element, which loads the feed line in a direction toward the high-pressure inlet. The high-pressure inlet has an annular sealing surface, which is situated in a sealing plane preferably extending at right angles to the longitudinal axis of the housing, and the valve carrier has, in a step-type narrowing, an annular outer sealing surface, which is situated in the sealing plane and rests sealingly on the annular sealing surface of the high-pressure inlet. The fastening element presses the feed line against the valve carrier and presses the latter against the high-pressure inlet, or the fastening element presses the feed line against an intermediate connection piece having a through feed bore for the fuel, and said connection piece presses the valve carrier against the high-pressure inlet.

There is furthermore preferably a cone angle difference $\alpha$; $\beta$ of 0.5° to 2° between the inner cone of the valve carrier or of the intermediate connection piece and the outer cone of the feed line, with the result that an annular sealing surface is formed at the smallest diameter of the contact surface of the tapers.

The annular sealing surface is preferably formed on the housing.

In one embodiment, the device for intermittently injecting high-pressure fuel into the combustion chamber of an internal combustion engine is provided with a fuel injection valve, which has a housing that has a high-pressure inlet, a recess and a high-pressure space, with a valve carrier, which has a fuel passage, with a check valve, which allows flow of the fuel from the high-pressure inlet through the fuel passage into the high-pressure space with as little hindrance as possible and at least restricts said flow in the opposite direction, with a feed line for feeding fuel to the fuel injection valve, and with a fastening element, which loads the feed line in a direction toward the high-pressure inlet. The high-pressure inlet has a conical sealing surface, and the valve carrier has a conical outer sealing surface on an outer circumferential surface, which sealing surface rests sealingly on the conical sealing surface of the high-pressure inlet. The fastening element presses the feed line against an intermediate connection piece fastened on the housing and having a through feed bore for the fuel, and said connection piece presses the valve carrier against the high-pressure inlet by means of its conical outer sealing surface.

In this embodiment, the intermediate connection piece is preferably provided with an external thread and is screwed into a corresponding mating thread of the housing in the connection segment.

The intermediate connection piece is preferably arranged completely in the housing and the fastening element is screwed into the mating thread by means of an external thread.

On an inlet end, the intermediate connection piece preferably has an inner cone, which forms a sealing surface and which is adjoined by the feed bore, wherein the feed line has, in its end region adjacent to the fuel injection valve, an outer cone, which forms a sealing surface and which rests sealingly on the inner cone of the intermediate connection piece.

On an inlet end, the valve carrier preferably has an inner cone, which forms a sealing surface and is adjoined by the fuel passage, wherein the intermediate connection piece has, in its end region adjacent to the fuel injection valve, an outer cone, which forms a sealing surface and which rests sealingly on the inner cone of the valve carrier.

As a further preferred option, the conical outer sealing surface and the inner cone are formed on a funnel-shaped end flange of the valve carrier.

There is in each case preferably a cone angle difference $\alpha$; $\beta$ of 0.5° to 2° between the conical sealing surface of the high-pressure inlet and the conical outer sealing surface of the valve carrier, between the inner cone of the valve carrier and the outer cone of the intermediate connection piece, and between the inner cone of the intermediate connection piece and the outer cone of the feed line, with the result that an annular sealing surface is formed in each case at the smallest diameter of the contact surface between the respective tapers.

In one embodiment, the device for intermittently injecting high-pressure fuel into the combustion chamber of an internal combustion engine is provided with a fuel injection valve, which has a housing that has a high-pressure inlet, a recess and a high-pressure space, with a valve carrier, which has a fuel passage, with a check valve, which allows flow of the fuel from the high-pressure inlet through the fuel passage into the high-pressure space with as little hindrance as possible and at least restricts said flow in the opposite direction, with a feed line for feeding fuel to the fuel injection valve, and with a fastening element, which loads the feed line in a direction toward the high-pressure inlet. The high-pressure inlet has a conical sealing surface, and the valve carrier has, on an outer circumferential surface, a conical outer sealing surface and a thread. The valve carrier is screwed by means of its thread into a mating thread of the housing in such a way that the conical outer sealing surface rests sealingly on the conical sealing surface of the high-pressure inlet. The fastening element presses the feed line against the valve carrier.

In all the embodiments, the check valve is assigned to the valve carrier and it is supported by the latter.

In this case, the fastening element is preferably designed as a screw and is likewise screwed into the mating thread.

BRIEF DESCRIPTION OF THE DRAWINGS

The invention is explained in detail by means of the embodiments shown in the drawing, in which, in purely schematic fashion.

In all the figures, the same reference numerals are used for corresponding parts.

DETAILED DESCRIPTION OF THE PRESENT INVENTION

Figure 1:
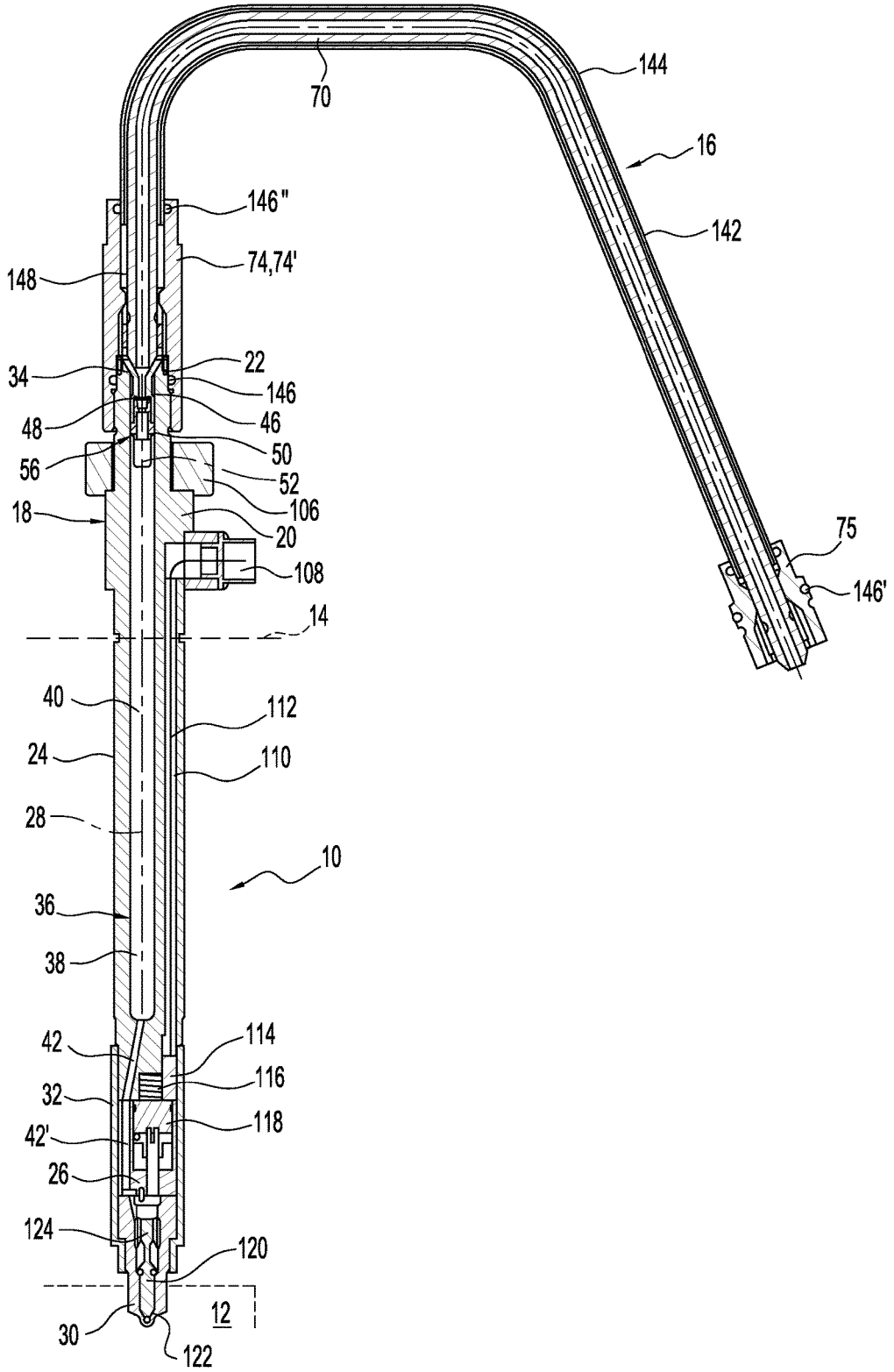
FIG. 1 shows a longitudinal section through a first embodiment of the device according to the invention for intermittently injecting high-pressure fuel into the combustion chamber of an internal combustion engine, wherein an injection valve and a feed line assigned to the latter are shown; of course, the device can have a plurality of injection valves and each of these injection valves can have a feed line.
Figure 2:
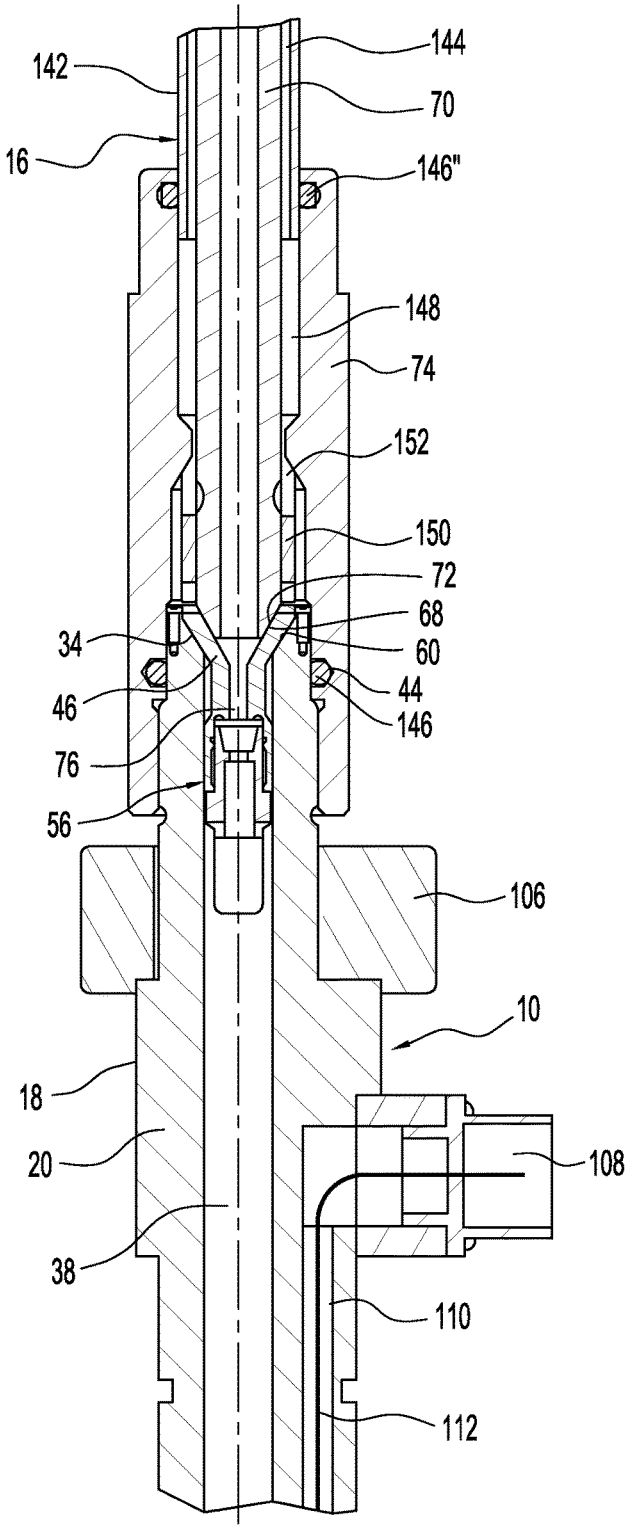
FIG. 2 shows part of the embodiment shown in FIG. 1 on an enlarged scale relative to the latter.
Figure 3:
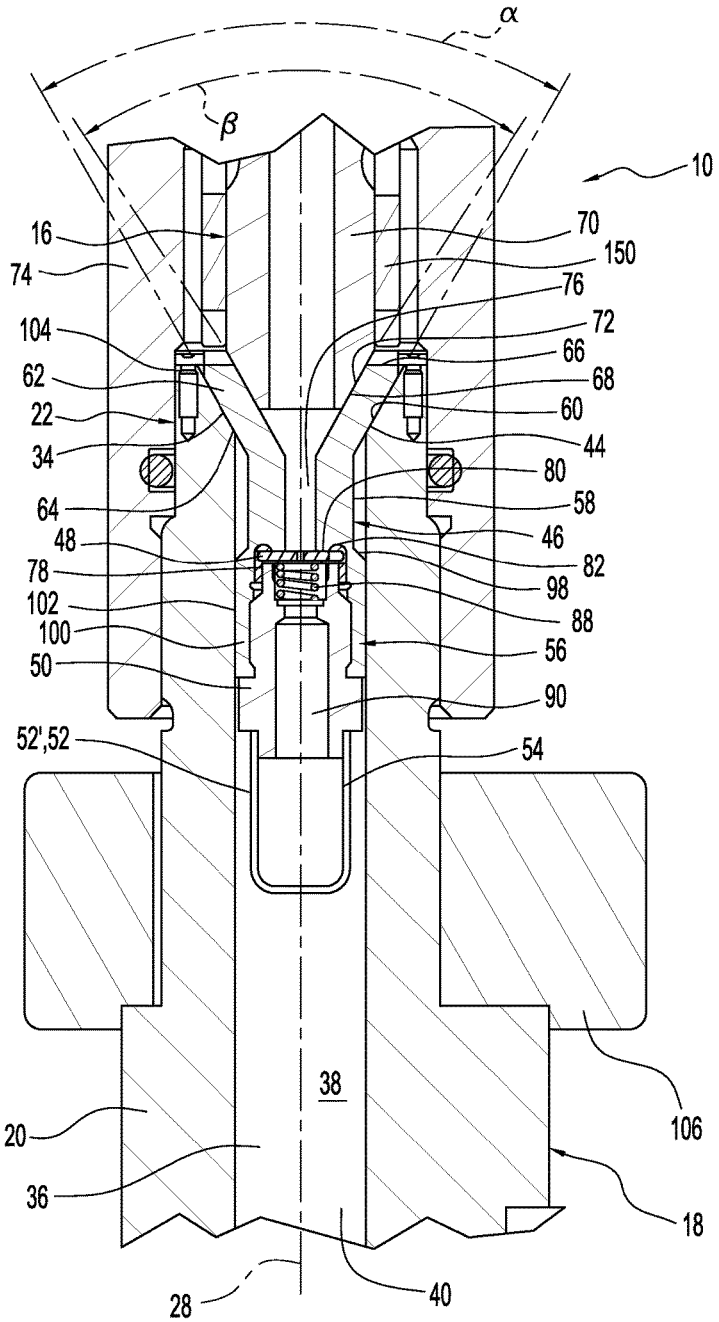
FIG. 3 shows part of the device shown in FIGS. 1 and 2 on an enlarged scale relative to FIG. 2.

FIGS. 1 to 3 show a fuel injection valve 10 for intermittently injecting high-pressure fuel into the combustion chamber 12 of an internal combustion engine 14, and a feed line 16 connected to the fuel injection valve 10, of a first embodiment of the device according to the invention. Of course, the device can have a plurality of fuel injection valves 10 with feed lines 16 assigned thereto.

At the other end, the feed line 16 is connected to a high-pressure delivery device, in particular a high-pressure pump, of the kind known from WO 2007/009279 A, for example. In this regard, attention is drawn explicitly to the disclosure in said publication.

The fuel injection valve 10 has a housing 18 with a storage body 20, on which a connection segment 22 and a storage segment 24 are formed integrally, i.e. in one piece.

The housing 18 furthermore has an intermediate body 26, which rests on the storage segment 24 on the side facing away from the connection segment 22, when viewed in the direction of a longitudinal axis 28 of the fuel injection valve 10.

The housing 18 furthermore carries a nozzle body 30, which rests on the outside of the intermediate body 26 which faces away from the storage body 20 and is fastened on the housing by means of a union nut 32. In the illustrative embodiment shown, the intermediate body 26 is arranged within the union nut 32, and this nut is screwed to the storage body 22 in such a way that the nozzle body 30 rests sealingly on the intermediate body 26, and the latter rests on the storage body 20.

A high-pressure inlet 34 is formed in the connection segment 22 on the housing 18, and it is connected to a high-pressure space 36 of the fuel injection valve 10.

This high-pressure space 36 has a discrete storage chamber 38 in the storage body 20. This design and mode of operation of a storage chamber 38 of this kind is known from document WO 2007/009279 A, the disclosure of which is incorporated by reference into this description.

A recess 40 in the form of a blind hole, which is rotationally symmetrical with respect to the longitudinal axis 28, which is elongate in the direction of the longitudinal axis 28, which delimits the discrete storage chamber 38 and from the base of which a conduit duct segment 42 extending obliquely to the longitudinal axis 28 extends to the intermediate body 26 in order to feed fuel to the nozzle body 30, extends in the storage body 20, from the connection-side end of the latter.

The recess 40 is formed in the connection segment 22 in such a way as to widen when viewed toward the free end of the storage body 20 in the direction of the longitudinal axis 28, with the result that a conical sealing surface 44 (see FIG. 2) of the high-pressure inlet 34 is formed. The opening angle α (see FIG. 3) of this conical sealing surface 44 is about 60° in the illustrative embodiment shown. The conical sealing surface 44 forms an inner cone on the storage body 20 and thus on the housing 18.

The fuel injection valve 18 furthermore has a valve carrier 46 and a check valve 48 arranged therein. Fastened on the valve carrier 46 is a holding element 50, which, for its part, carries a filter 52 for the fuel, which, in the present case, is designed as a cup-type filter body 52' having microholes 54. At least 2000 such microholes 54 with a diameter of 20 to 50 μm are preferably present. However, the filter 52 can also be designed as a rod-type filter 53, as shown in FIGS. 10 to 13 and described below.

Figure 9:
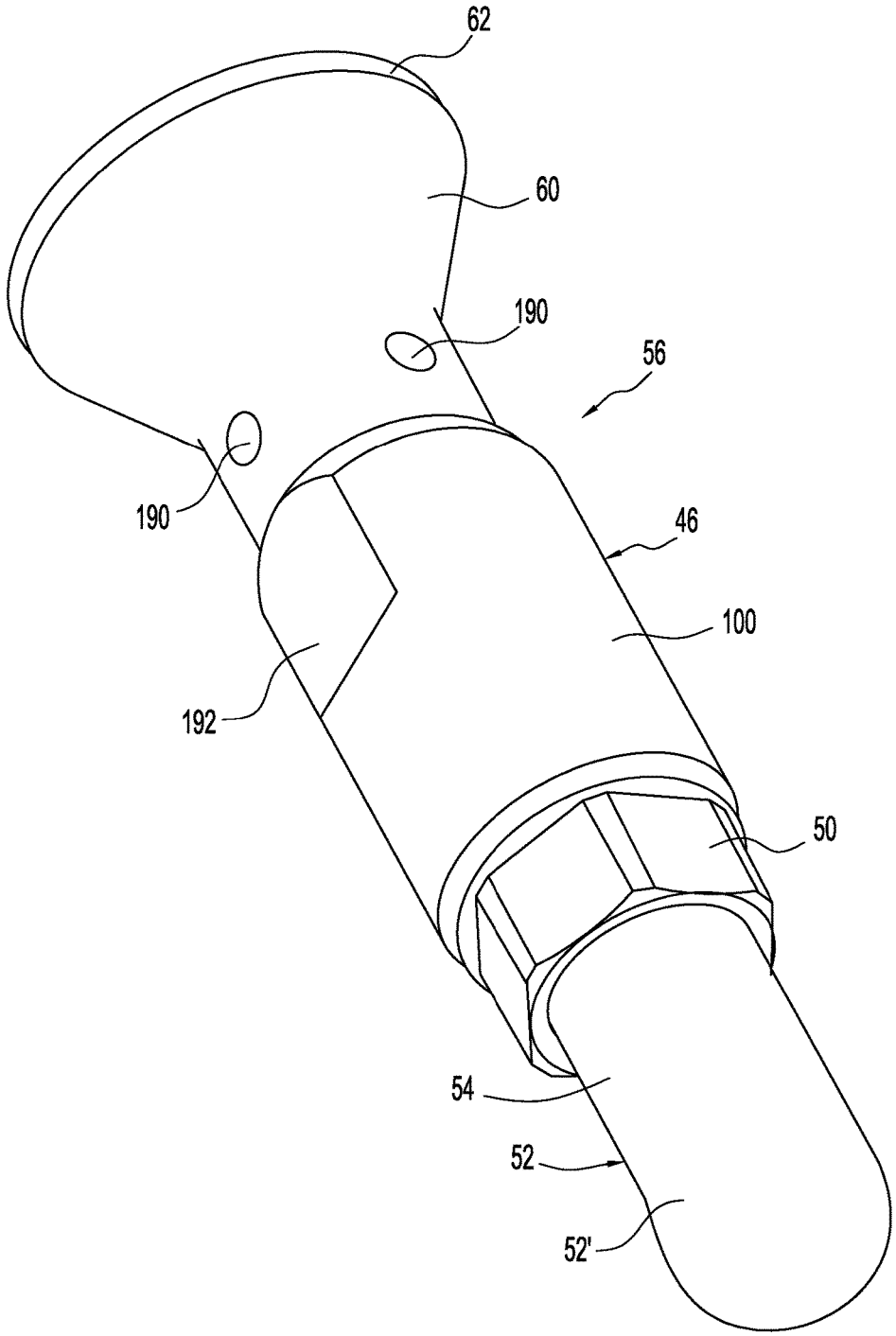
FIG. 9 shows, in perspective view, the self-contained, cartridge-type modular unit with the valve carrier, the holding element and the filter carried by the latter, wherein the check valve is arranged in the valve carrier.
Figure 10:
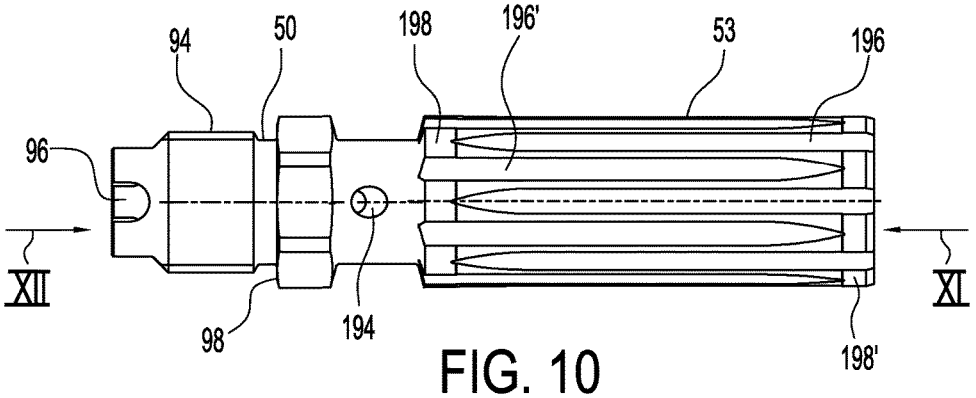
FIG. 10 shows the holding element and a rod-type filter in elevation, wherein these two parts are formed integrally with one another.
Figure 11:
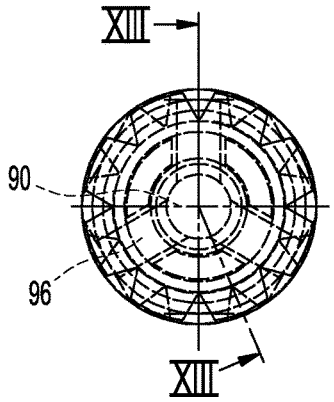
FIG. 11 shows the holding element and the rod-type filter in side view in the direction of arrow XI in FIG. 10.
Figure 12:
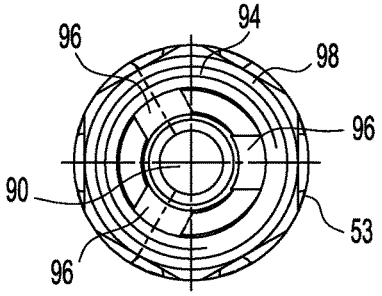
FIG. 12 shows the holding element and the rod-type filter in side view in the direction of arrow XII in FIG. 10.

In the illustrative embodiment shown, the valve carrier 46, together with the check valve 48, holding element 50 and filter 52, is designed as a self-contained, cartridge-type modular unit 56, similar to that shown in FIG. 9.

The modular unit 56 is inserted as such into the recess 40 delimiting the discrete storage chamber 38 and thus into the high-pressure space 36.

On its outer circumferential surface 58, the valve carrier 46, which is designed to be rotationally symmetrical with respect to the longitudinal axis 28, has a conical outer sealing surface 60, which, in the illustrative embodiment shown, is formed on a funnel-shaped, inlet-side end flange of the valve carrier 46. The valve carrier 46 rests sealingly on the sealing surface 44 by means of its outer sealing surface 60, which forms an outer cone, wherein the angle β of the conical outer sealing surface 60 is designed to be smaller than the angle α, and this cone angle difference is preferably 0.5° to 2°. As a result, particularly good leak-tightness is achieved since the common contact surface of the tapers forms an annular sealing surface 64 at the smallest diameter (FIG. 3).

On an inlet end 66, the valve carrier 46 furthermore has an inner cone 68, which forms a sealing surface and, in the illustrative embodiment shown, is likewise formed on the end flange 62. The opening angle of this inner cone 68 is once again about 60°.

In the illustrative embodiment under consideration, the feed line 16 is of double-walled design for monitoring any leakage of fuel, as is often required especially for marine applications. An inner tube 70 is intended to carry the fuel, which is under very high pressure. In each of its two end regions, it has an outer cone 72, which forms a sealing surface and which tapers toward the end of the inner tube 70.

By means of its outer cone 72 on the end region adjacent to the fuel injection valve 10, the inner tube 70 rests sealingly on the inner cone 68 of the valve carrier 46.

In the manner explained in connection with the conical sealing surface 44 and the outer sealing surface 60, the angle of the outer cone 72 of the inner tube 70 is designed to be smaller than the angle of the inner cone 68 of the valve carrier 46, preferably by a cone angle difference of 0.5° to 2°, in order once again to form an annular sealing surface at the smallest diameter of the contact surface of the tapers.

The feed line 16 is fastened on the storage body 20 by means of a fastening element 74 designed as a connection nut 74' and, in particular, the inner tube 70 is thereby loaded in a direction toward the fuel injection valve 10. As a result, the inner tube 70 rests sealingly by means of its outer cone on the inner cone 68 of the valve carrier 46, and the latter rests by means of its outer sealing surface 60 on the sealing surface 44 of the fuel injection valve 10. The valve carrier 46 and thus the modular unit 56 are thus held clamped directly between the housing 18 of the fuel injection valve 10 and the feed line 16.

The valve carrier 46, which is designed so as to be at least approximately rotationally symmetrical with respect to the longitudinal axis 28, has a fuel passage 76, which leads from the outer cone 72 into a check valve space 78 centrally with respect to the longitudinal axis 28. Said valve space is delimited, on the one hand, by the valve carrier 46 and, on the other hand, by the holding element 50, which is screwed into the valve carrier 46 from the end thereof remote from the inner cone 68.

Formed on the valve carrier 46 at the opening of the fuel passage 76 into the check valve space 78 is a flat annular check valve seat 80, which surrounds the opening of the fuel passage 76. In the illustrative embodiment shown, the valve carrier 46 furthermore has an encircling undercut 82, which surrounds the check valve seat 80.

The check valve 48 furthermore has a check valve member 84 (see FIG. 4), which is arranged in the check valve space 78 and, in the illustrative embodiment shown, is designed as a valve plate 84'. When the check valve 48 is closed, the check valve member 84 or valve plate 84' rests sealingly on the check valve seat 80.

The check valve member 84 is provided with a restrictor passage 86, which is designed as a central through bore through the valve plate 84' in the illustrative embodiment shown. By means of this restrictor passage 86, the high-pressure space 36 or discrete storage chamber 38 is fluidically connected (in a restricted manner) to the high-pressure inlet 34, even when the check valve 48 is closed.

Supported by one end on the side of the check valve member 84 facing away from the fuel passage 76, there is a compression spring 88, which is supported by its other end on the holding element 50. The compression spring 88 acts as a closing spring for the check valve 48 and ensures that the check valve member 84 rests on the check valve seat 80 at a balanced pressure.

Centrally with respect to the longitudinal axis 28, the holding element 50 has a further fuel passage 90, which leads from the check valve space 78 to the free end of the holding element 50. The cross section of this further fuel passage 90 is the same as or larger than the cross section of fuel passage 76.

In the end region adjacent to the check valve space 78, the further fuel passage 90 has a step-type widening, into which the compression spring 88 fits and on the step of which the compression spring 88 is supported at this end.

That end of the holding element 50 which is on the check valve side is furthermore spaced apart from the check valve seat 80 in such a way that the holding element 50 forms a stop for the valve plate 84' in the open position and, in this position, the through flow cross section delimited by the check valve seat 80 and the valve plate 84' is at least the same as or preferably larger than the cross section of the fuel passage 76.

Figure 4:
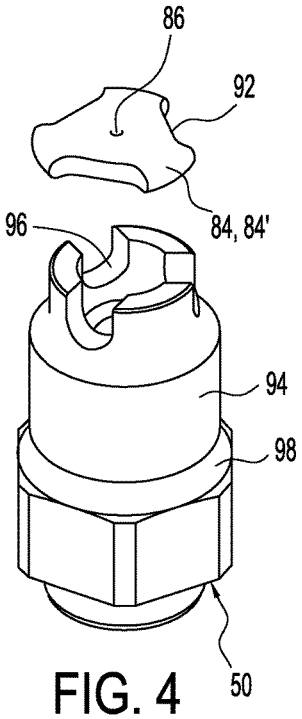
FIG. 4 shows, in perspective view, a holding element and a check valve member designed as a valve plate, which, together with a valve carrier and, if appropriate, a filter, form a self-contained, cartridge-type modular unit.

In order to ensure as much as possible a low-loss flow of the fuel from the high-pressure inlet 74 into the high-pressure space 36 while achieving a space-saving construction, the valve plate 84' in the illustrative embodiment shown—see also FIG. 4—has three apertures 92, which are distributed uniformly in the circumferential direction, are open in a radially outward direction and pass through in the direction of the longitudinal axis 28. Between the apertures 92, the radially outer rim of the valve plate 84' is circular with respect to the longitudinal axis 28. A sufficiently large passage between the valve plate 84' and the wall of the holding element 50 has thus been created, irrespective of the rotational position and lateral position of the valve plate 84'.

As is particularly evident from FIG. 4, the holding element 50 has a reduced outside diameter in an end region adjoining the thread 94 and adjacent to the check valve space 78 in order to form between said diameter and the wall of the holding element 50 an annular space which is sufficiently large in terms of flow. In this region, the holding element 50 has three grooves 96, which are distributed in the circumferential direction, pass through in a radial direction and are open in a direction toward the valve plate 84'. These ensure a sufficiently large through flow cross section from the check valve space 78 into the further fuel passage 90, irrespective of the rotational position and lateral position of the valve plate 84'.

Purely for the sake of completeness, it may be mentioned that, between the thread 94, by means of which it is screwed into a corresponding internal thread of the valve carrier 46, and a free end region, the holding element 50 is designed as a polygon, in particular a hexagon, to enable the holding element 50 to be tightened on the valve carrier 46 by means of a tool. A step 98 between the thread 94 and the polygon serves as a stop on the valve carrier 46 and defines the relative axial position in the assembled state.

The filter 52 is mounted on the cylindrical free end region of the holding element 50. This has a cup-type filter body 52' with the microholes 54. The filter body 52' is preferably welded to the holding element 50.

Adjoining the end flange 62, as far as the end adjacent to the holding element 50, the valve carrier 46 has a circular-cylindrical shape radially on the outside, with a step approximately in the middle. The outside diameter in the segment adjoining the end flange 62, up to the step, is smaller than in the segment following the step, a guide segment 100, as viewed in a direction toward the interior of the fuel injection valve 10. There is a narrow gap 102 between this guide segment and the housing 18 or the storage body 20 thereof. During assembly, the guide segment 100 facilitates the introduction of the modular unit 56 into the high-pressure space 36 or the recess 40 and the storage chamber 38 and aligns the modular unit. It would also be possible to dispense with the guide segment 100 here.

For the sake of completeness, it may be mentioned that screws 104 screwed into the housing 18 hold the modular unit 56 in place on the housing 18 by means of their heads when the feed line 16 is not connected to the fuel injection valve 10.

As can be seen from FIG. 1, the fuel injection valve 10 is held fast on the cylinder head of the internal combustion engine 14 in a known manner by means of a bracket 106.

An electrical connection 108 is furthermore arranged on the housing 18, on the storage body 20 in the illustrative embodiment shown, from which connection a duct 110 extends parallel to the longitudinal axis 28 through the wall delimiting the storage chamber 38 as far as the end adjacent to the intermediate body 26. A control line 112 is passed through the duct 110 from the electrical connection 108, said line carrying connection contacts 114 at the other end.

For the sake of completeness, it may be mentioned that, on this side, the storage body 20 has a central recess in the form of a blind hole, which is open toward the intermediate body 26 and in which a compression spring 116 is arranged. This serves to hold fast an electrically controlled actuator arrangement 118, which is connected to the connection contacts 114 and which is accommodated in a corresponding recess in the intermediate body 26.

Figure 5:
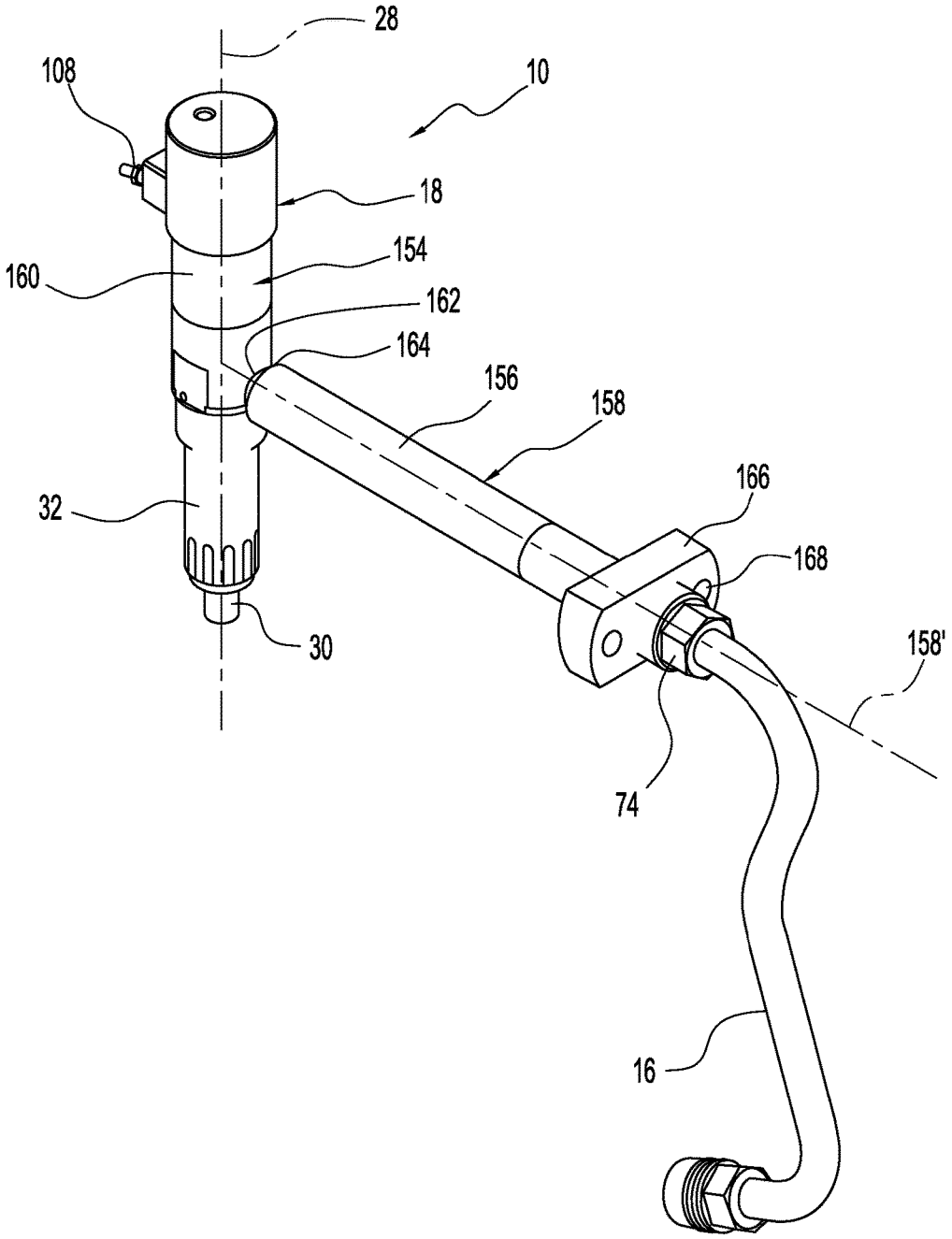
FIG. 5 shows another embodiment of the device according to the invention, wherein the housing has, on the one hand, a valve housing with a lateral conical contact pressure surface and, on the other hand, a pressure connection piece, on which the high-pressure inlet is formed.

Actuator arrangements 118 of this kind are widely known and, in the present case, it is designed in the manner shown in FIG. 5 of document WO 2008/046238 A and described in detail therein. As regards construction and mode of operation, attention is drawn expressly to this document. However, actuator arrangements of different design can be used.

Extending through the intermediate body 26 next to the recess for the actuator arrangement 118, parallel to the longitudinal axis 28, is a further conduit duct segment 42', which is fluidically connected to conduit duct segment 42 and, at the other end, opens into the part of the high-pressure space 36 which is delimited by the nozzle body 30.

Arranged in this part in such a way as to be movable in the direction of the longitudinal axis 28 is an injection valve member 120 of needle-type design, which interacts with an injection valve seat 122 formed on the nozzle body 30 in a known manner. In the state of rest, the injection valve member 120 rests on the injection valve seat 122 and thus prevents fuel from emerging from the high-pressure space 36 into the combustion chamber 12. For injection, the injection valve member 120 is raised briefly from the injection valve seats 122, whereby fuel is injected into the combustion chamber 12 through the injection nozzles, which are formed in a known manner on the nozzle body 30.

In its end region remote from the injection valve seat 122, the injection valve member 120 forms a piston 124, which is guided in a guide sleeve 126 as a tight sliding fit. Supported on the guide sleeve 126 is a closing spring 128 designed as a compression spring, which is supported at the other end on the injection valve member 120 and subjects the latter to a spring force directed in a direction toward the injection valve seat 122.

At the other end, the guide sleeve 126 is pressed sealingly against an intermediate plate by means of the closing spring 128. The piston 124, the guide sleeve 126 and the intermediate plate delimit a control space 130.

To control the movement of the injection valve member 120 in the axial direction, the pressure in the control space is adjusted by means of a hydraulic control device 132. For this purpose, the control device 132 has an intermediate valve 134 with an intermediate valve member which, in the open position, exposes a high-pressure passage, which is formed on the intermediate plate and which leads from the high-pressure space 36 into the control space 130, and, in the closed position, closes said control space in order to separate the control space 130 from the high-pressure space 36.

The intermediate valve member separates the control space 130 permanently from a valve space 136, with the exception of a restrictor passage, via which the control space 130 is continuously connected to the valve space 136 via a small flow cross section.

The actuator arrangement 118 has an electromagnet 138, which is connected to the control line 112 and actuates a control stem 140. In the state of rest, the control stem 140 closes a low-pressure outlet from the valve space 136. In the activated state of the electromagnet 138, that is to say for an injection, the control stem 140 exposes the low-pressure outlet; the fuel running out of the valve space 136 through said outlet is carried to a low-pressure fuel tank in a known manner via a low-pressure return line.

The detailed construction and the mode of operation of fuel injection valves 10 as shown in FIG. 1 are described in detail in publications WO 2007/098621 A and WO 2008/046238 A, for example. The other embodiments and further known embodiments disclosed in these documents can likewise be used in the fuel injection valve 10 under consideration.

The construction and mode of operation of the feed line 16, which is embodied with a double shell, corresponds to the prior art and is shown and described in detail in the earlier international patent application WO 2013/117311 A, for example.

To enable any leakage of fuel to be monitored, the feed line 16 is of double-walled design. The inner tube 70 is intended to carry the fuel, which is under very high pressure. It extends within a (thin-walled) outer tube 142, wherein there is a leakage return gap 144 between said outer tube and the inner tube 70; see especially FIG. 2.

At each of its two ends, the feed line 16 has a connection nut 74 and 75, respectively, wherein the connection nut 74' on the same side as the fuel injection valve, which forms the fastening element 74, has an internal thread for screwing onto a corresponding external thread on the housing 18 or storage body 20, and the other connection nut 75 has an external thread for screwing into a distributor element or distributor block of the kind known from document WO 2007/009279 A, for example; it would therefore also be possible to use the term connection screw 75.

The connection nut 74' assigned to the fuel injection valve 10 furthermore has a circumferential groove, which is open inwardly in a radial direction and into which an O-ring 146 is inserted, said O-ring interacting in the assembled state with a corresponding sealing surface on the housing 18 or storage body 20 in order to avoid the escape of fuel via the thread. In corresponding fashion, the other connection nut 75 has an outwardly open circumferential groove with an O-ring 146' inserted therein.

Passing through the connection nut 74' is a nut passage 148, through which the inner tube 70 extends, forming a gap. In its axial end regions at both ends, the nut passage 148 is of larger diameter design. The outer tube 142 fits into the end region of the nut passage 148 remote from the fuel injection valve 10, wherein a further O-ring 146" acting between connection nut 74' and the outer tube 142 prevents fuel escaping from the nut passage 148 into the environment; FIG. 2.

In the end region of the nut passage 148 adjacent to the fuel injection valve 10, a fastening sleeve 150 is screwed by means of its central segment onto an end region of the inner tube 70 adjoining the outer cone 72. In its end region remote from the free end of the feed line 16, the fastening sleeve 150 has four groove-shaped leakage recesses 152, which lie crosswise opposite one another and pass through in a radial direction. Here, the fastening sleeve 150 is provided on the outside with a narrowing taper, which interacts with a corresponding conical surface on connection nut 74'.

In the assembled state, the outer cone 72 of the inner tube 70 is held leaktightly on the inner taper 68 of the valve carrier 46, and the outer sealing surface 60 of said carrier is held leaktightly on the conical sealing surface 44 of the housing 18 or storage body 20 thereof, by means of connection nut 74' via the fastening sleeve 150. If one or both of these seals leaks, the leaking fuel flows through the nut passage 148 into the leakage return gap 144 and, from the latter, flows back in a known manner to a leakage monitoring sensor, preferably in the low-pressure fuel tank.

Figure 6:
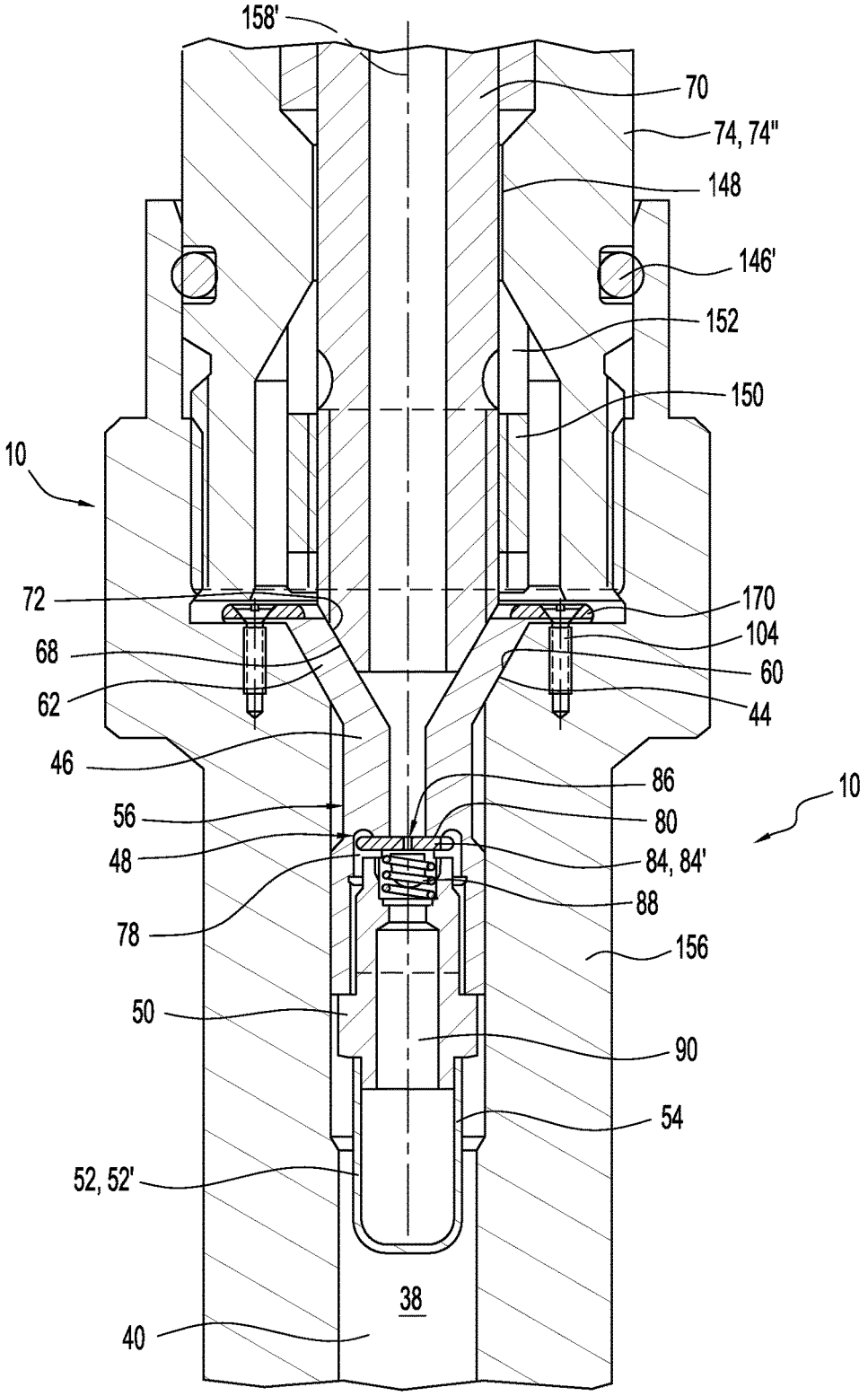
FIG. 6 shows part of the pressure connection piece and the feed line connected thereto in longitudinal section.

Another embodiment of the device according to the invention is shown in FIGS. 5 and 6, wherein the housing 18 of the fuel injection valve 10 has a valve housing 154 and a connection piece housing 156 of a pressure connection piece 158. A fuel injection valve 10 having a valve housing 154 of this kind and a pressure connection piece 158 is known from document WO 2009/033304 A. The construction and mode of operation of the fuel injection valve 10 are disclosed in detail in that document, and the disclosure thereof is incorporated by reference herein.

In comparison with the embodiment shown in FIGS. 1 to 3 and described above, the connection piece housing 156 in the present case is formed by the storage body 20 with the discrete storage chamber 38 but without the electrical connection 108, duct 110, control line 112, connection contacts 114 and recess for a compression spring 116.

Accordingly, the valve housing 154 in the embodiment shown in FIGS. 5 and 6 has, instead of the storage body 20, a connection body 160, on that end of which which is adjacent to the nozzle body 30 (as shown in FIG. 1) the intermediate body 26 with the actuator arrangement 118 mounted thereon. This intermediate body is arranged within the union nut 32, which at one end is supported on the nozzle body 30 and at the other end is screwed onto the connection body 160, in a manner similar to that shown in FIG. 1 and described above.

The electrical connection 108 is furthermore mounted on the connection body 160. In other respects, the interior of the valve housing 154 shown in FIG. 5 can be designed in a manner similar to FIG. 1.

A lateral conical contact pressure surface 162 designed as a sealing surface is furthermore formed on the connection body 160. The hydraulic high-pressure connection from the feed line 16 to the valve housing 154 is implemented by means of the pressure connection piece 158.

The longitudinal axis 158' of the pressure connection piece 158 extends at right angles to the longitudinal axis 28 of the valve housing 154. Longitudinal axis 158' also forms the rotational axis for the contact pressure surface 162.

In its end region adjacent to the valve housing 154, the connection piece housing 156 is shaped as a conical mating contact pressure surface 164, which likewise acts as a sealing surface and rests sealingly on the contact pressure surface 162.

In the interior of the connection piece housing 156, the recess 40 is formed with the discrete storage chamber 38 or at least part of the discrete storage chamber 38, from which a conduit duct segment extends toward the free end and is connected there to the high-pressure space in the interior of the valve housing 154. In a manner similar to the embodiment shown in FIG. 1, a second part of the discrete storage chamber 38 can be in the valve housing 154.

For the sake of completeness, it may be mentioned that a fastening flange 166 having two through holes 168 projects from the connection piece housing 156. These holes are intended to receive clamping screws, which are supported by their heads on the fastening flange 166 and are screwed into the cylinder head in order to hold the pressure connection piece 158 in leaktight contact with the valve housing 154.

According to FIG. 6 and in a manner similar to the embodiment shown in FIGS. 1 to 3, see especially FIG. 3, the recess 40 in the connection piece housing 156, which extends in the direction of the longitudinal axis 158' and also forms at least part of the discrete storage chamber 38, has the conical sealing surface 44 on the connection side in the connection segment 22. Inserted in corresponding fashion into the recess 40 is the self-contained modular unit 56, which is of precisely identical design and is held in a sealing manner, as described above and shown in FIGS. 1 to 3. The valve carrier 46 rests by means of its outer sealing surface 60 on the conical sealing surface 44. In the assembled state, the inner tube 70 of the feed line 16 likewise engages by means of its outer cone 72 in the inner cone 68 of the valve carrier 46 and rests sealingly thereon.

In order to hold the valve carrier 46 and thus the modular unit 56 in a fixed manner on the connection piece housing 156, even when the feed line 16 is not connected, the screws 104 are screwed into said housing, pulling a retaining ring 170 against the connection piece housing 156, which ring is supported on the end of the valve carrier 46. This solution can be employed with all the embodiments.

In the region in which the feed line 16 is connected to the connection piece housing 156, the only difference with respect to the embodiment shown in FIGS. 1 to 3 is that an internal thread is formed in a connection recess in the connection piece housing 156, into which thread a connection screw 74" forming the fastening element 74 is screwed by means of its external thread instead of connection nut 74', said screw being otherwise identical in design to connection nut 74'. In other words, the region of connection of the feed line 16 is designed like the region of connection in the end, remote from the fuel injection valve 10, of the feed line 16 in accordance with the embodiment according to FIGS. 1 to 3.

Figure 7:
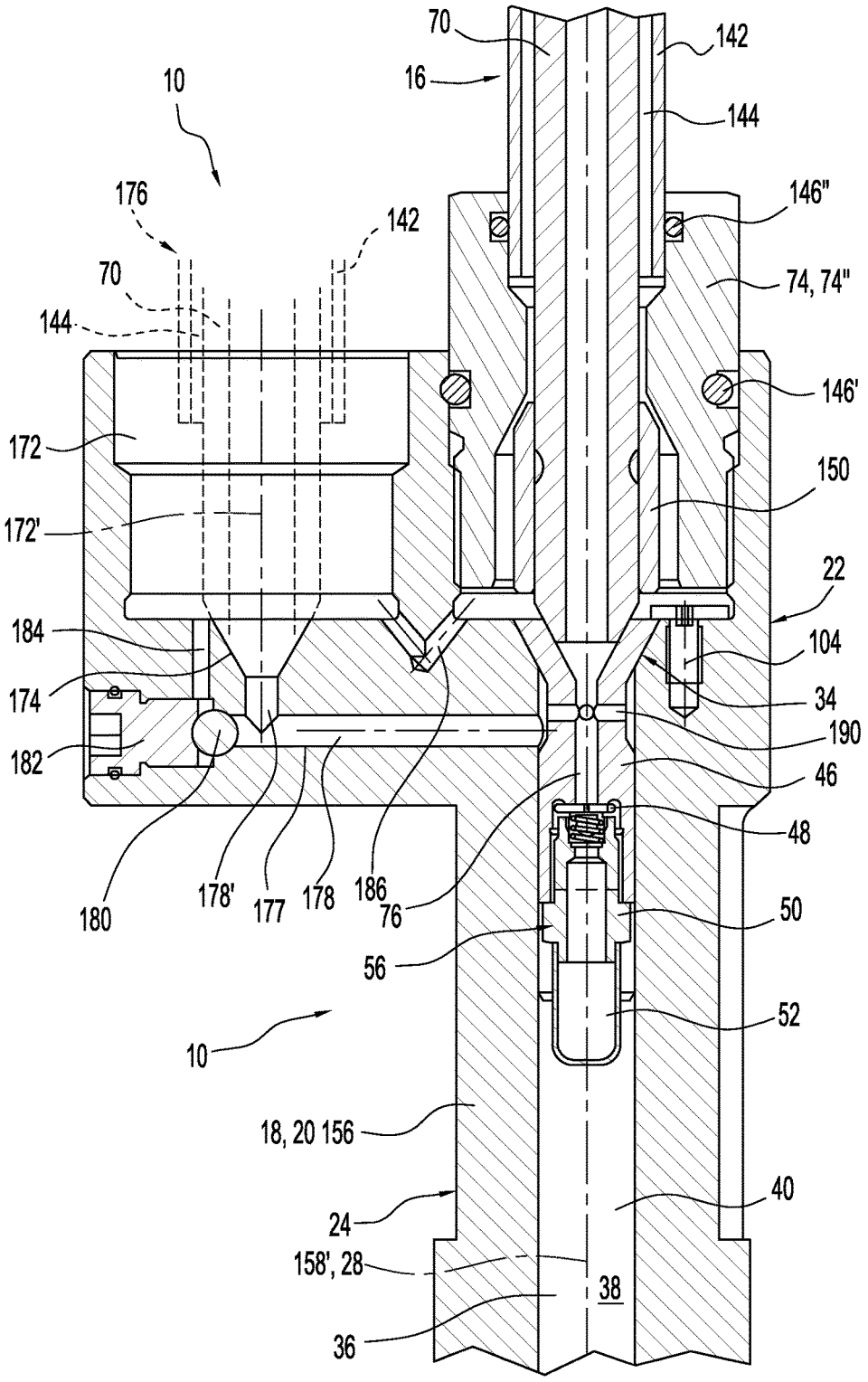
FIG. 7 shows another embodiment, in which the housing of the injection valve or of the pressure connection piece is provided with a high-pressure outlet next to the high-pressure inlet.
Figure 8:
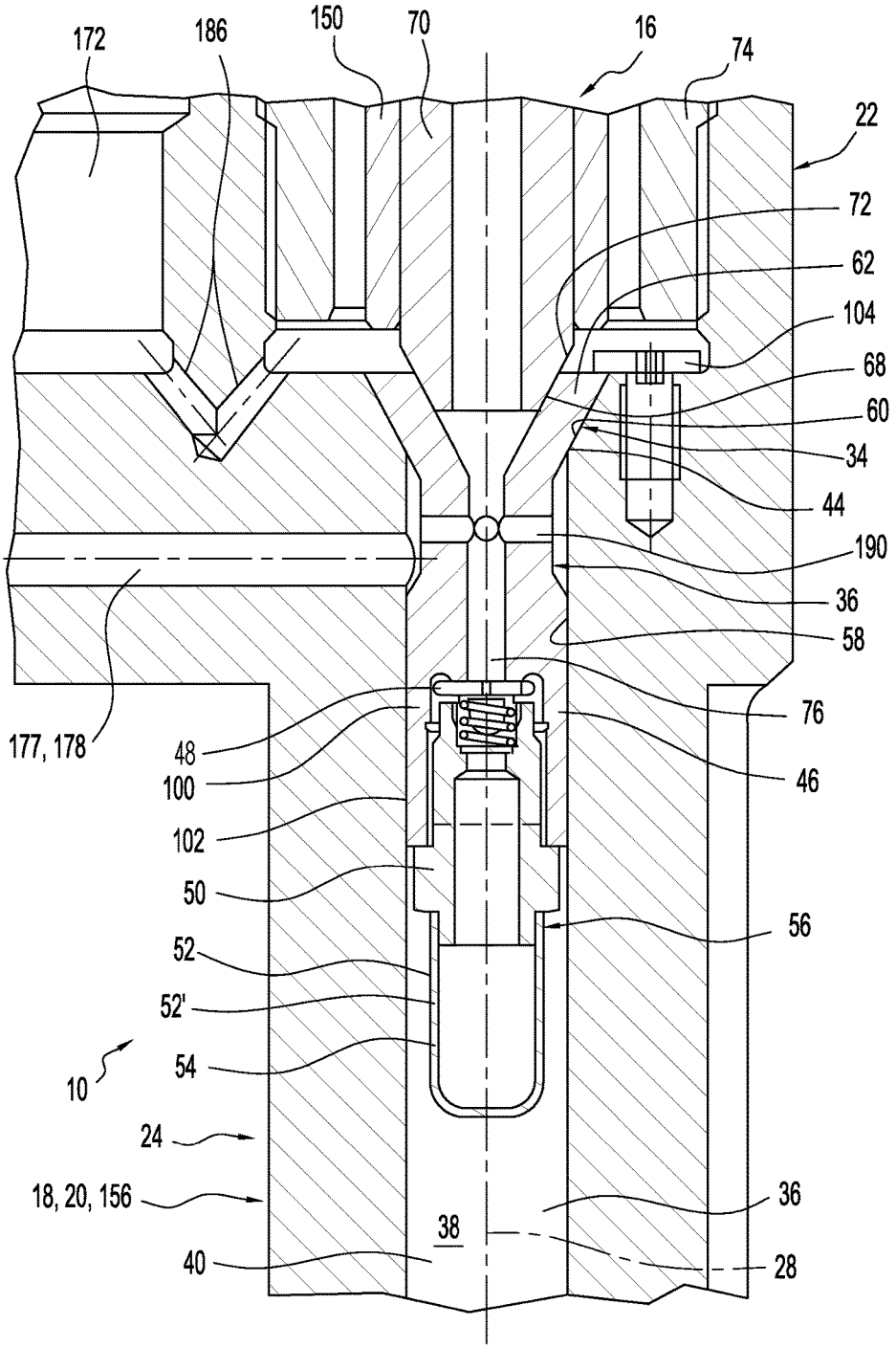
FIG. 8 shows part of the embodiment shown in FIG. 7 on an enlarged scale relative to the latter.

FIGS. 7 and 8 show the connection segment 22 of the housing 18 or of the storage body 20 or of the connection piece housing 156 of another embodiment of the device according to the invention, wherein the fuel injection valve 10 can be designed as shown in FIGS. 1 to 3 and 5 and 6 and correspondingly described, with the exception of the connection segment 22.

The high-pressure element 34 is formed on the housing 18 of the high-pressure inlet 34 centrally with respect to longitudinal axis 28—or 158'—just as shown in FIG. 6 and described above. In the embodiment under consideration, however, the valve carrier 46 is held in the recess 40 by means of the head of a screw 104—without a retaining ring 170—when the feed line 16 is not connected.

A high-pressure outlet 172 is formed on the housing 18 or storage body 20 or connection piece housing 156 parallel to the high-pressure inlet 34 and offset laterally relative to the latter. In corresponding fashion, the housing 18 is of head-like design in the connection segment 22, and it has a lateral extension.

The geometry of the high-pressure outlet 172 is similar to that of the high-pressure inlet 34. Starting from the bottom of the high-pressure outlet 172 there is a conical, tapering sealing surface 174, which has the same geometry as the inner cone 68 on the valve carrier 46. It serves to interact with an outer cone 72 on a connecting line 176 of identical design to the feed line 16. This connecting line is used to feed a further fuel injection valve 10 and is indicated only schematically.

A hydraulic connection 177 extends in the housing 18 from the sealing surface 174 to the recess 40. As viewed in the direction of longitudinal axis 28 or 158', the opening into the recess 40 is situated at the valve carrier 46, at the reduced outside diameter thereof, i.e. between the end flange 62 or the outer sealing surface 60 and the guide segment 100; see also FIG. 3.

In the illustrative embodiment shown, the connection 177 consists of a radial bore 178 opening into the recess 40 and of a longitudinal bore 178', which starts from the end of the conical sealing surface 174, opens into said radial bore and is central with respect to the connection axis 172' of the high-pressure outlet 172. In an end region adjoining the lateral outer surface of the housing 18, the transverse bore 178 has a larger cross section and, in this region, is designed in such a way as to narrow inwardly in the form of a step. Arranged in the inner end of this end region is a sealing ball 180, which is held in such a way by means of a contact pressure plug 182 screwed into the end region and sealed that the radial bore 178 is sealed off as regards high pressure. For this purpose, the radial bore 178 can have a conically tapering sealing surface adjoining the end region, against which the sealing ball 180 is pressed.

Extending from an annular space extending around the sealing ball 180, on the side facing the contact pressure plug 182 and parallel to the connection axis 172', is a longitudinal leakage bore 184 leading to the bottom of the high-pressure outlet 172, where, as viewed in the radial direction, it opens into the recess in the housing 18 for the high-pressure outlet 172 outside the sealing surface 174 and forms a leakage monitoring opening there.

Oblique leakage bores 186, which open into one another, furthermore extend from the bottom of the recesses in the housing 18, which form the high-pressure inlet 34 and the high-pressure outlet 172, from the mutually facing sides. For the sake of completeness, it may be mentioned that the openings of the oblique leakage bores 186 are situated to the outside of the sealing surface 174 or of the conical sealing surface 44 in the radial direction and likewise form leakage monitoring openings.

Of course, leakage bores, such as the longitudinal leakage bore 184 and oblique leakage bores 186, are not necessary if leakage monitoring is dispensed with. In this case, the feed line 16 and the connecting line 176 do not have to be of double-walled design either; it then does not have an outer tube 142.

If any seal or the inner tube 70 leaks, the leaking fuel is passed through the leakage return gap 144 to a leakage monitoring device. In this regard, attention is drawn to the disclosure in international patent application WO 2013/117311 A.

In contrast to the embodiments shown in FIGS. 1 to 6, the valve carrier 46 in the embodiment under consideration has at least one radial outlet 190, in the illustrative embodiment shown, four radial outlets 190 extending crosswise, between the end flange 62 or the outer sealing surface 60 and the inner cone 68, on the one hand, and the guide segment 100, on the other, in the direction of the longitudinal axis 28 (FIG. 8). Said radial outlet or outlets is/are thus likewise arranged between the inner cone 68 and the check valve 48, and a preferably restriction-free connection between the fuel passage 76 and thus the feed line 16 and the high-pressure outlet 172 or connecting line 176 is made possible.

In this embodiment, the guide segment 100 of the valve carrier 46, which guide segment is downstream of the radial outlet 190 in the direction of flow into the fuel valve 10, is preferably designed to be longer than in the embodiments shown above, and the gap 102 is narrower. By means of these measures, both problem-free mounting of the valve carrier 46 or modular unit 56 and a hydraulic separation between the discrete storage chamber 38 and the connecting line 176 is made possible in a simple manner, at least for transient processes.

In other respects, the modular unit 56 is of precisely the same design as in the other embodiments of the fuel injection valve 10.

FIG. 9 shows the modular unit 56 of the embodiment according to FIGS. 7 and 8 in perspective. As described above, this modular unit consists of the valve carrier 46, the check valve 48 present therein, the holding element 50 screwed into the valve carrier 46, and the filter 52 carried by the holding element 50.

In the region of the guide segment 100, two mutually opposite chamfers 192 are formed on the valve carrier 46, serving for the engagement of an open-ended wrench to enable the holding element 50 to be tightened.

The modular unit 56 in the embodiments according to FIGS. 1 to 6 is of exactly the same design, although the valve carrier 46 does not have a radial outlet 190 and the length of the guide segment 100 can be less.

This preassembled, self-contained modular unit 56 can be introduced without problems into the recess 40 until it rests by means of the outer sealing surface 60 of the valve carrier 46 on the conical sealing surface 44 of the housing 18.

Instead of the filter body 52' with the microholes 54, the rod-type filter 53 can be provided as filter 52, as it can in the other embodiments also. In the embodiment shown in FIGS. 10 to 13, the rod-type filter 53 and the holding element 50 are formed integrally, i.e. in one piece, with one another. As a result, the rod-type filter 53 is also part of the modular unit 56 and can accordingly be inserted into the recess 40 together with the valve carrier 36 and the check valve 48 from the direction of the high-pressure inlet 34. However, mention may also be made of the possibility of designing the rod-type filter 53 as a self-contained component and of holding it by means of an interference fit in the recess 40, as described in document EP 2 188 516 and shown there in FIG. 7 (see reference signs 72 and 72'). In this case, the modular unit 56 comprises the valve carrier 46, the check valve 48 and the holding element 50 with a further fuel passage 90.

In the embodiment shown in FIGS. 10 to 13, the holding element 50 with its further fuel passage 90, the thread 94, the open grooves 96 and the step 98 with the polygonal profile is of the same design as shown and described in connection with FIGS. 1 to 3 and, in particular, FIGS. 4 to 7. Integrally adjoining the end described there, there is now the rod-type filter 53, which closes the further fuel passage 90 in the manner of a blind hole in the axial direction. Instead, three radial passages 194 here extend from the further fuel passage 90 into the annular space between the holding element 50 and the housing 18 or the storage body 20 thereof or connection piece housing 156, said passages sloping in the direction of flow of the fuel.

Figure 13:
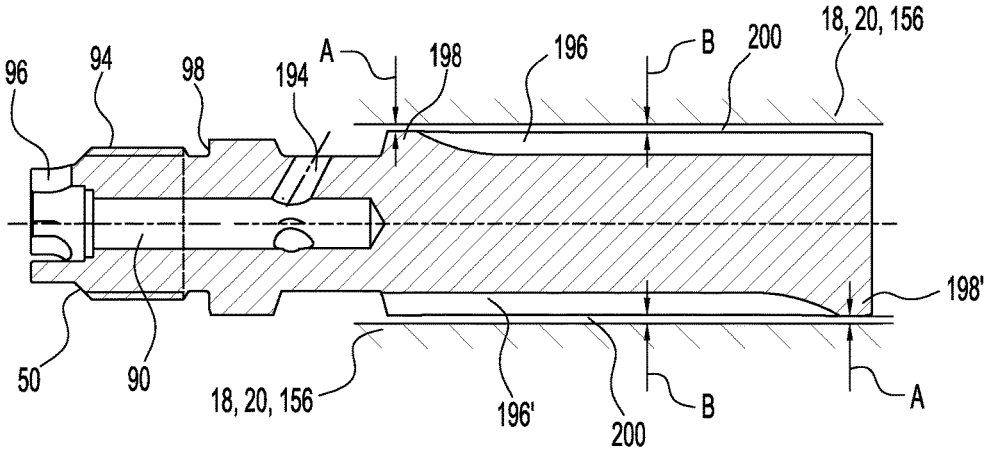
FIG. 13 shows the holding element with the rod-type filter according to FIG. 10 in longitudinal section along the line XIII-XIII in FIG. 11.

It should be noted that, in FIG. 13, the housing 18 or the storage body 20 or the connection piece housing 156 indicated there is shown at a greater distance from the rod-type filter 53 than is effectively the case, for the sake of greater clarity.

The rod-type filter 53 is of cylindrical design and, on its circumference, has longitudinal grooves 196, 196', which are distributed in the circumferential direction and which are open alternately to the high-pressure space 36 and to the radial passages 194 but, at the other end, are virtually closed and, as measured in the axial direction, overlap one another over a significant part of the length of the rod-type filter 53. In the region of this overlap, the outside diameter of the rod-type filter 53 is of slightly smaller design than in the two axial end regions 198 and 198', which virtually close the longitudinal grooves 196 and 196'. The reduced diameter in the region of overlap, together with the housing 18 or storage body 20 or connection piece housing 156, delimits filter gaps 200, which allow the fuel to flow from longitudinal grooves 196' into longitudinal grooves 196 but retain solid particles.

In the two end regions 198 and 198', the spacing A between the rod-type filter 53 and the housing 18 or storage body 20 or connection piece housing 156 is about 5 to 10 micrometers—outside the region of the longitudinal grooves 196, 196', which are in each case open there. The width of the filter gaps 200 between the rod-type filter 53 and the housing 18 or storage body 20 or connection piece housing 156 is preferably about 30 to 40 micrometers, in particular about 35 micrometers.

Figure 15:
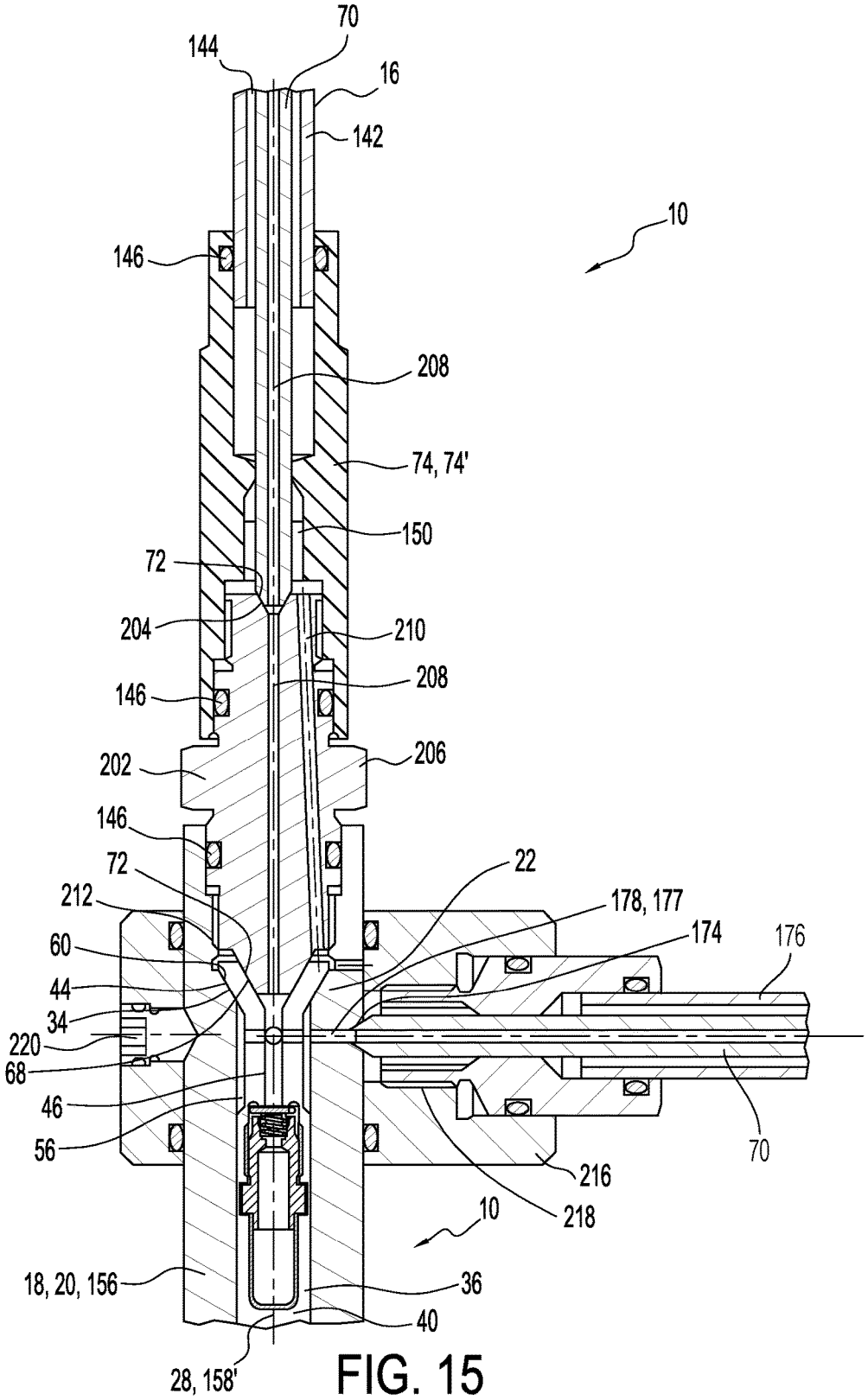
FIG. 15 shows an embodiment in which an intermediate connection piece has an outer cone which interacts with the inner cone of the valve carrier, in a longitudinal section corresponding to FIG. 6.
Figure 16:
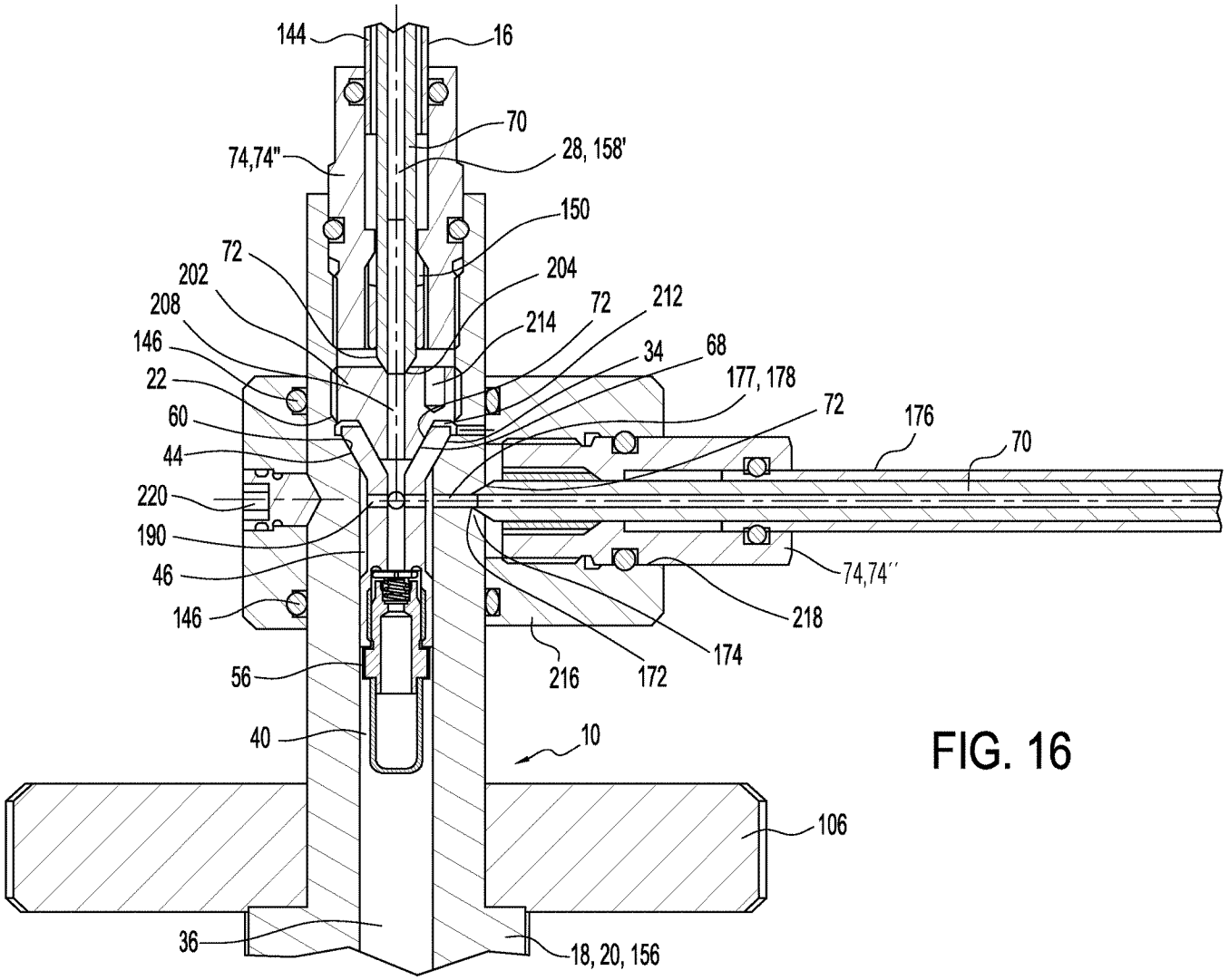
FIG. 16 shows an embodiment with an intermediate connection piece, although this is of shorter design, likewise in a longitudinal section corresponding to FIG. 6.
Figure 17:
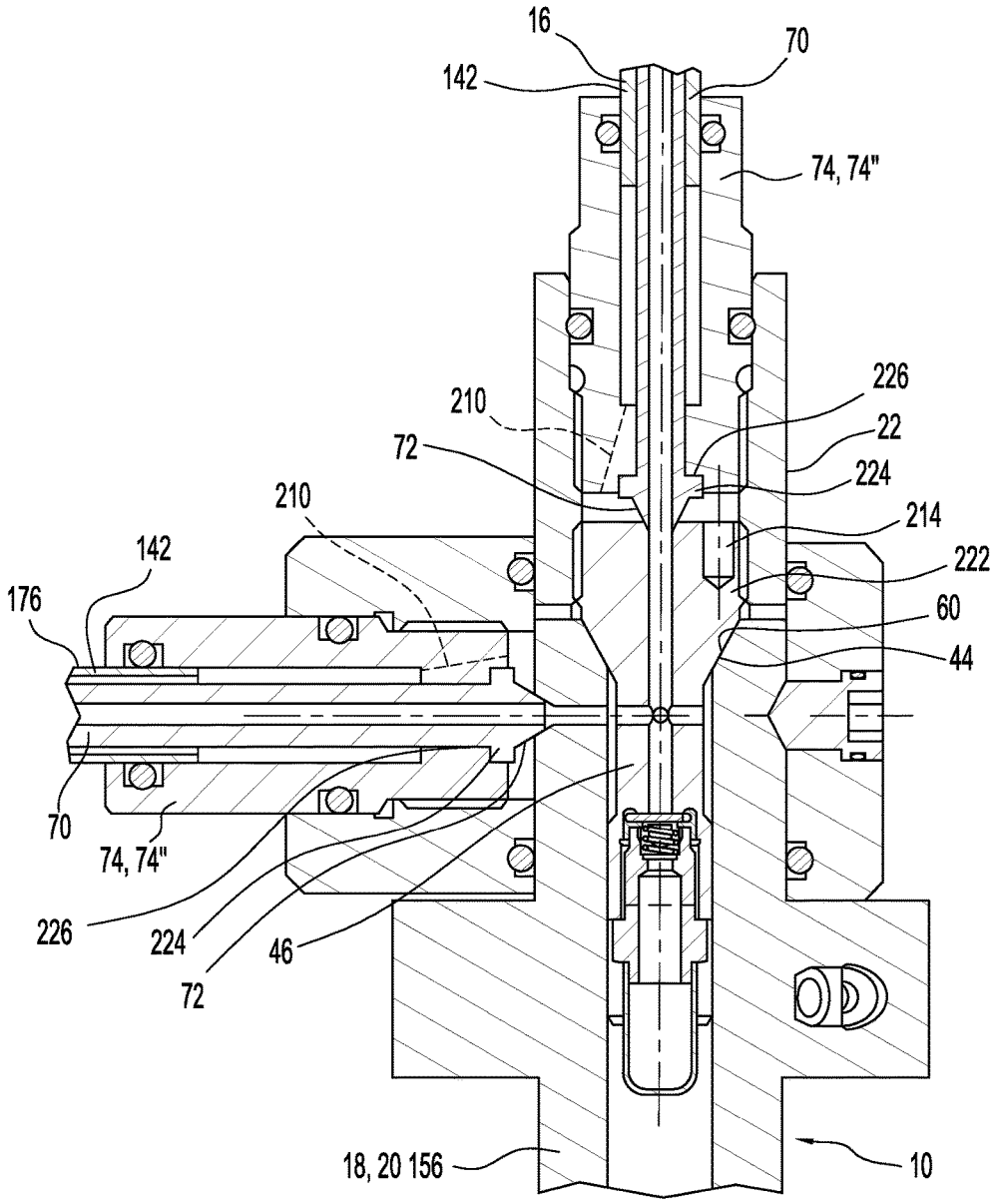
FIG. 17 shows an embodiment in which the valve carrier itself has a thread for the fastening thereof, likewise in a longitudinal section corresponding to FIG. 6.

There is also the possibility of designing the feed line 16 or the inner tube 70 with a smaller outside diameter than the embodiments shown in FIGS. 1 to 3 and 6 to 8 and, if the pressure conditions require it (which is virtually always the case), also with a smaller inside diameter; see also FIGS. 15, 16 and 17. In this case, the volume of the discrete storage chamber 38 is preferably of correspondingly large or larger design.

In this case too, the outer cone 72 of the feed line 16 or the inner tube 70 is pressed sealingly against the inner cone 68 of the valve carrier 46 or end flange 62 thereof by means of the fastening element 74. The conical outer sealing surface 60 of the valve carrier 46 or end flange 62 thereof is thus also pressed against the conical sealing surface 44 of the housing 18.

However, since it is possible in this case that the feed line 16 or the inner tube 70 will be too weak to press the valve carrier 46 against the housing 18 in a reliably sealing manner against the pressure in the storage chamber 38, the retaining ring 170 shown in FIG. 6, for example, can be made correspondingly more robust and can be fastened in a correspondingly more stable manner on the housing 18, thus ensuring leaktightness between the outer sealing surface 60 and the conical sealing surface 44, even in the case of pressure surges.

Figure 14:
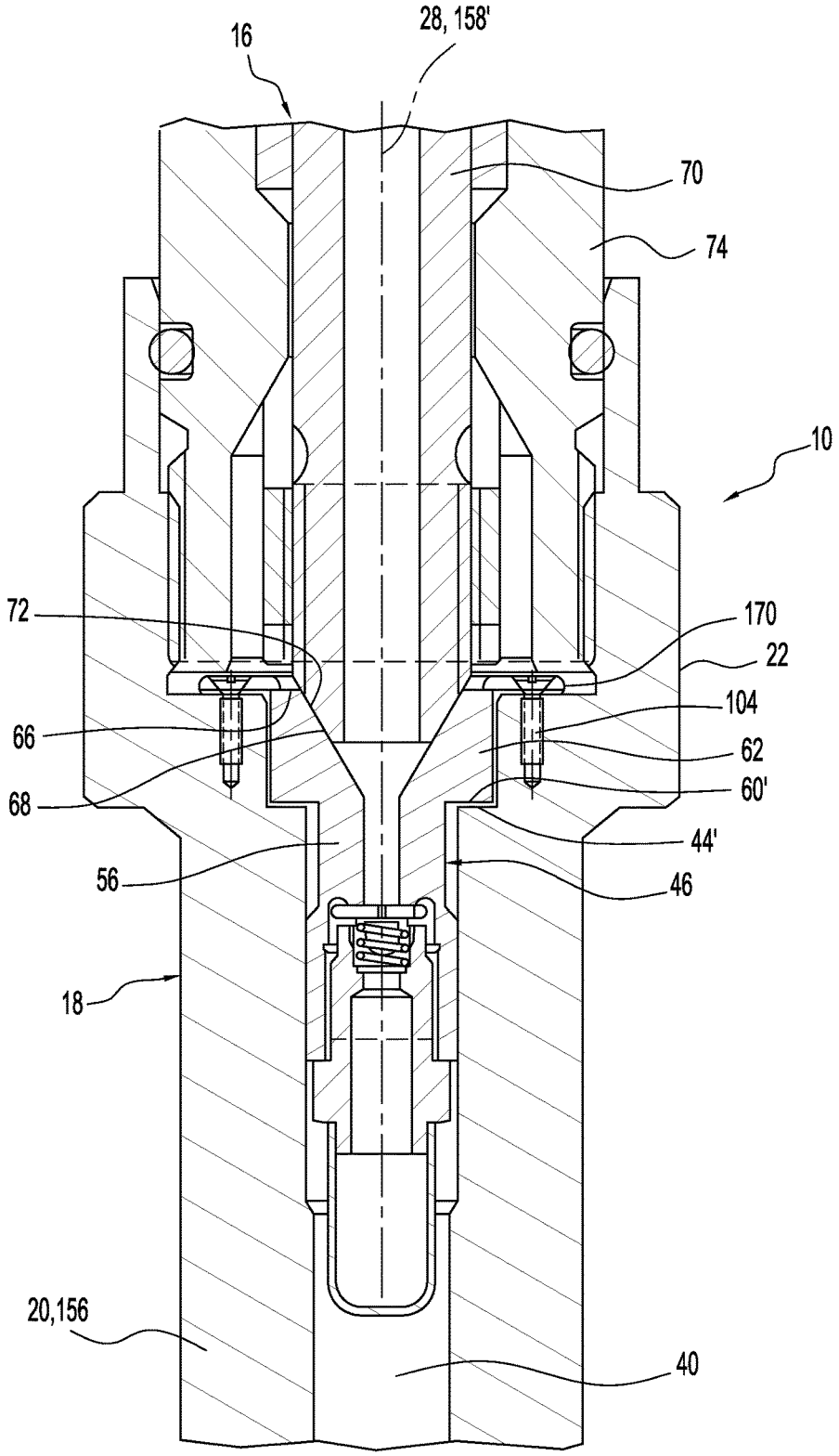
FIG. 14 shows an embodiment in which the outer sealing surface of the valve carrier and the associated sealing surface of the housing lie in one plane, in a longitudinal section corresponding to FIG. 6.

FIG. 14 shows an embodiment in which the device is of identical design to that shown and described in connection with FIG. 6, with the differences that the end flange 62 of the valve carrier 46 is of circular-cylindrical design radially on the outside and that, at the end remote from the inlet side, the outer sealing surface 60', which lies in a sealing plane extending at right angles to the longitudinal axis 28 or 158', is designed as an annular sealing surface in a step-type narrowing on the end flange 62. Additionally, in corresponding fashion, the connection segment 22 of the housing 18 or storage body 20 or connection piece housing 156 has a circular-cylindrical segment of the recess 40—to accommodate the end flange 62—with a step-type narrowing to form an annular sealing surface 44' situated in the sealing plane. Here too, the valve carrier 46 has the inner cone 68 forming the sealing surface on its inlet end 66, said inner cone interacting sealingly with the outer cone 72 of the feed line 16 or of the inner tube 70, as described above.

The fastening element 74, which is here once again designed as a connection screw 74" with an external thread, presses the feed line 16 or the inner tube 70 thereof against the valve carrier 46, and presses the latter against the annular sealing surface 44'. In this case too, given appropriate configuration of the connection segment 22, the fastening element 74 can also be designed as a connection nut 74', as shown in FIGS. 1 to 3.

In other respects, the device shown in FIG. 14 can be designed in the same way as shown in the other figures and correspondingly described.

Here too, the retaining ring 170 and the screws 104 can be of correspondingly more robust design in order not only to hold the modular unit 56 in place when the feed line 16 is removed but also to increase the contact pressure force with which the outer sealing surface 60' of the end flange 62 is pressed against the sealing surface 44'.

FIGS. 15 and 16 show two embodiments in which the conical outer sealing surface 60 of the valve carrier 46 is pressed sealingly against the conical sealing surface 44 of the high-pressure inlet 34 by means of an intermediate connection piece 202. These embodiments are preferably used when the feed line 16 (when not of double-walled design) or the inner tube 70 of the feed line 16 of double-walled design are designed with relatively small diameters; in this respect, see the feed line 16 in FIGS. 1 to 3 and 6 to 8, which have larger diameters. There, the outside diameter of the feed line 16 or of the inner tube 70 thereof is larger than the diameter of the recess 40 (outside the conical connection segment) in the cylindrical region. Here, however, the outside diameter of the feed line 16 or of the inner tube 70 is smaller than the diameter of the recess 40 in the cylindrical region.

The fuel injection valve 10, in particular the modular unit 56 with the valve carrier 46, is of identical design to that shown in the other figures and described above.

In the connection segment 22, the recess 40 in the housing 18 or storage body 20 or connection piece housing 156 has the conical sealing surface 44, on which the valve carrier rests sealingly by means of its conical outer sealing surface 60, as described above.

However, it may be mentioned that the housing 18 or storage body 20 or connection piece housing 156 and the valve carrier 46 can also be designed as shown in FIG. 14.

Adjoining the sealing surface 44, the housing or storage body 20 or connection piece housing 156 has an internal thread toward the free end in the connection segment 22, into which thread the intermediate connection piece 202 is screwed by means of a corresponding external thread; in FIG. 15 this being similar to the connection screw 74" in the embodiments in FIGS. 7 to 8 and 14.

In its end region adjacent to the fuel injection valve 10 and thus to the valve carrier 46, the outer cone 72 is formed on the intermediate connection piece 202, said outer cone interacting sealingly with the inner cone 68 of the valve carrier 46, as disclosed above, especially in connection with FIGS. 1 to 3 and 6 to 8. There, the corresponding outer cone 72 is formed on the feed line 16 or on the inner tube 70.

At its end remote from the outer cone 72, an internally tapered sealing surface 204, on which the inner tube 70 of the feed line 16 rests sealingly by means of its outer cone 72, is formed on the intermediate connection piece 202, which is of one-piece design.

Extending through the intermediate connection piece 202, centrally with respect to longitudinal axis 28 or 158', there is a feed bore 208 for feeding the fuel from the feed line 16 to the fuel injection valve 10, that is to say to the modular unit 56 thereof.

In the embodiment shown in FIG. 15, the intermediate connection piece 202 projects above the housing 18 or storage body 20 or connection piece housing 156. Just as shown in FIGS. 1 to 3 and correspondingly described, the connection nut 74', which presses the inner tube 70 against the internally tapered sealing surface 204 by means of the fastening sleeve 150, is screwed onto a corresponding external thread of the intermediate connection piece 202.

Formed on the intermediate connection piece 202 between the housing 18 or storage body 20 or connection piece housing 156 and the connection nut 74' is an external bead 206 which, in the radial direction, projects beyond the connection nut 76 and the end region of the housing 18 on this side and on which application surfaces for a tool, e.g. a hexagon, are formed for the application of an open-ended wrench.

The intermediate connection piece 202 can thus be screwed into the housing 18 or storage body 20 or connection piece housing 156 with sufficient force in a simple manner.

If, to return leaking fuel, the feed line 16 is of double-walled design with an inner tube 70 and an outer tube 142, two O-rings 146 inserted into corresponding circumferential grooves that are open radially outward are provided on the intermediate connection piece 202, said O-rings forming a seal between the intermediate connection piece 202 and, on the one hand, the housing 18 or storage body 20 or connection piece housing 156 and, on the other hand, the connection nut 74'. In this case, a leakage bore 210 is formed in the intermediate connection piece 202, said bore connecting the leakage return gap 144 via the nut passage 148 to a leakage space 212 in the form of a gap delimited by the housing 18 or storage body 20 or connection piece housing 156, the valve carrier 46 and the intermediate connection piece 202.

Any fuel emerging from the high-pressure space 36 on this side is thereby carried back to the feed line 16 and through the leakage return gap 144 thereof, as described above.

In the embodiment shown in FIG. 16, the intermediate connection piece 202 is of shorter design in the axial direction than in the embodiment shown in FIG. 15, and is arranged within the housing 18 or storage body 20 or connection piece housing 156, in the connection segment 22 thereof.

Between the internally tapered sealing surface 204 and the external thread of the intermediate connection piece 202, the end thereof is of flat design. Three blind holes 214 extend parallel to longitudinal axis 28 or 158' and approximately centrally in the radial direction between the internally tapered sealing surface 204 and the external thread from this end, being distributed in the circumferential direction. These bores are used for engagement with a corresponding pin-type socket wrench, the pins of which can engage in the blind holes 214 in order to tighten the intermediate connection piece 202 in such a way that the outer cone 72 of the intermediate connection piece 202 rests sealingly on the inner cone 68 of the valve carrier 46, and the latter rests sealingly by means of its outer sealing surface 60 on the conical sealing surface 44.

The fastening element 74 is of identical design to the embodiments shown in FIGS. 6 to 8 and 14, being designed as a fastening screw 74", which presses the outer cone 72 of the inner tube 70 of the feed line 16 sealingly against the internally tapered sealing surface 204 of the intermediate connection piece 202 via the fastening sleeve 150.

In the embodiments shown in FIGS. 15 and 16, the valve carrier 46 is provided with the radial outlets 190, as shown and explained in connection with FIGS. 7 and 8, in order to supply a further fuel injection valve 10 with fuel via a connecting line 176. However, if there is no further fuel injection valve 10 to be supplied in this way, the valve carrier 46 can be formed without the radial outlets 190, as shown in FIGS. 1 to 3, 6 and 14.

At this point, it may be mentioned that it is also possible in the embodiments shown in FIGS. 15 and 16 for the valve carrier 46 and the housing 18 or storage body 22 or connection piece housing 156 to be designed with sealing surfaces 60', 44' arranged in a plane extending at right angles to the longitudinal axis 28, 158', thereby corresponding to the embodiment shown in FIG. 14.

To feed a further fuel injection valve 10, the connection segment 22 of the housing 18 or storage body 20 or connection piece housing 156 can be of identical design to that shown in FIG. 7 and described above, namely having a high-pressure outlet 178.

FIGS. 15 and 16 show an alternative solution to the feeding of a further fuel injection valve 10, wherein this solution can also be used in the other embodiments.

At least approximately at the level of the radial passages 190 of the valve carrier 46, as viewed in the direction of longitudinal axis 28 or 156', there is a radial bore 178 forming the hydraulic connection 177 extending from the recess 40 through the wall of the housing 18 or storage body 20 or connection piece housing 156. Its outer end region in the radial direction is designed as a conical sealing surface 174, on which the inner tube 70 of the connecting line 176 rests sealingly by means of its outer cone 72.

The housing 18 or storage body 20 or connection piece housing 156 is surrounded by a clamp 216, which is arranged in such a way that its radial passage 218 is in alignment with the radial bore 178.

In the region of the radial passage 218, the clamp 216 is provided with an internal thread, into which the fastening element 74 designed as a connection screw 74" is screwed in order to press the inner tube 70 sealingly against the housing 18 or storage body 20 or connection piece housing 156.

In order additionally to fix the clamp 216 on the housing 18 or storage body 20 or connection piece housing 156, it can have a bore with a thread, preferably on the opposite side from the radial passage 218, into which thread a, preferably sealing, screw 220 is inserted, the blunt tip of which engages at the free end of the stem in a corresponding depression in the housing 18 or storage body 20 or connection piece housing 156.

In the case where the feed line 16 and the connecting line 176 are of double-walled design to allow any leaking fuel to be returned, O-rings 146 above and below the radial bore 178 and the radial passage 218 form a seal between the housing 18 or storage body 20 or connection piece housing 156 and the clamp 216 in order to avoid the escape of leaking fuel.

In this case, the intermediate connection piece 202 is furthermore provided with a leakage bore 210, and the housing 18 or storage body 20 or connection piece housing 156 is provided with leakage passages in the embodiment shown in FIG. 16 too, as already shown in FIG. 15, in order to establish a leakage connection between the connecting line 176 and the leakage return gap 144 of the feed line 16 via the leakage space 212.

For the sake of completeness, it may be mentioned that, in the embodiment shown in FIG. 16, the intermediate connection piece 202 and the fastening element 74 of the feed line 16, said element being designed as a connection screw 74", are screwed into the same thread in the connection segment 22 of the housing 18 or storage body 20 or connection piece housing 156.

In the embodiment shown in FIG. 17, the housing 18 or storage body 20 or connection piece housing 156 is of identical design to that shown in FIG. 16 and described in connection therewith.

The valve carrier 46 is also of identical design, with the exception that it is now of integral design with the intermediate connection piece 202 shown in FIG. 16, i.e. they are formed in one piece.

Accordingly, the valve carrier 46 has, adjoining the outer sealing surface 60 thereof, a cylindrical segment 222 with an external thread, which is screwed into the corresponding internal thread in the connection segment 22 of the housing or storage body 20 or connection piece housing 156 in such a way that it rests sealingly by means of its conical outer sealing surface 60 on the conical sealing surface 44 of the housing 18 or storage body 20 or connection piece housing 156.

Moreover, in contrast to the embodiments described above, the inner tubes 70 of the feed line 16 and of the connecting line 176 and the corresponding fastening elements 74 are of different design. By means of plastic deformation of the inner tube 70 in the free end regions thereof, an encircling contact pressure ring 224 projecting in a radial direction, on the one hand, and, adjoining the latter as far as the free end, the outer cone 72 are formed on said tubes.

The fastening element 74, which is here designed as a connection screw 74" although it can also be designed as a connection nut 74', interacts directly in a corresponding manner, by means of an annular contact pressure surface 226 formed thereon, with the contact pressure ring 224 in order to hold the inner tube 70 in sealing contact with the housing 18 or storage body 20 or connection piece housing 156.

For the sake of completeness, it may be mentioned that the blind holes 214, which are formed on the intermediate connection piece 202 according to FIG. 16, are now formed on the valve carrier 46 itself to enable the latter to be tightened.

In this embodiment according to FIG. 17 too, the feed line 16 can be of double-walled design with an outer tube 142 and an inner tube 70 carrying the fuel, as illustrated, in order to return any leaking fuel. As known from the embodiments described above, leakage bores 210 are accordingly provided in this case.

However, it is also possible here to embody the feed line and, if appropriate, the connecting line 176 with a single wall, in which case the feed line 16 corresponds in design to the inner tube 70. The invention also relates to the embodiments described in greater detail below.

According to a first embodiment of the invention, there is provided a device for intermittently injecting high-pressure fuel into a combustion chamber of an internal combustion engine, having a fuel injection valve 10. The valve has a housing 18 that has a high-pressure inlet 34, a recess 40 and a high-pressure space 36, having a valve carrier 46. The valve carrier has a fuel passage 76, having a check valve 48 which allows flow of the fuel from the high-pressure inlet 34 through the fuel passage 76 into the high-pressure space 36 with as little hindrance as possible and at least restricts the flow in the opposite direction. The device has a feed line 16 for feeding fuel to the fuel injection valve 10, and has a fastening element 74 which loads the feed line 16 in a direction toward the high-pressure inlet 34. The high-pressure inlet 34 has a conical sealing surface 44. The valve carrier 46 has a conical outer sealing surface 60 on an outer circumferential surface 58, which sealing surface rests sealingly on the conical sealing surface 44 of the high-pressure inlet 34. The fastening element 74 presses the feed line 16 against the valve carrier 46 and presses the latter against the high-pressure inlet 34.

According to another aspect of the invention, the valve carrier 46 has an inner cone 68 at an inlet end 66, which inner cone forms a sealing surface and is adjoined by the fuel passage 76, and the feed line 16 has an outer cone 72 in its end region adjacent to the fuel injection valve 10, said outer cone forming a sealing surface which rests sealingly on the inner cone 68 of the valve carrier 46.

According to other aspects of the invention, the conical sealing surface 44 of the high-pressure inlet 34 may be formed on the housing 18; the valve carrier 46 may be formed as a self-contained, cartridge-type modular unit 56 together with the check valve 48 and a holding element 50 fastened on the valve carrier 46 and is inserted as such into the recess 40 of the housing 18; the modular unit 56 may be inserted into the recess 40 from the direction of the high-pressure inlet 34; and the holding element 50 may have a further fuel passage 90.

According to yet other aspects of the invention, the modular unit 56 may have a filter 52 for the fuel, in particular a cup-shaped filter body 52' with microholes 54 or a rod-type filter 52" which may be carried by the holding element 50 and to which the fuel flows, if appropriate through the further fuel passage 90; the recess 40 may form at least part of the high-pressure space 36, and the modular unit 56 may be inserted into the high-pressure space 36.

According to yet further aspects of the invention, an annular check valve seat 80 of the check valve 48 may be formed on the valve carrier 46, and a check valve member 84 interacting with the check valve seat 48, preferably designed as a valve plate 84' and provided with a restrictor passage 86, may be arranged between the valve carrier 46 and the holding element 50; the check valve member 84 designed as a valve plate 84' may have at least one aperture 92 open in a direction radially toward the outside and passing through in the direction of the longitudinal axis 28—preferably three such apertures 92 distributed in the circumferential direction; and the holding element 50 may have, in its end region adjacent to the valve plate 84', at least one groove 96 open in a direction toward the valve plate 84' and passing through in a radial direction—preferably three such grooves 96 distributed in the circumferential direction—in order to allow flow of the fuel with as little hindrance as possible when the check valve 48 is open.

Furthermore, according to other aspects of the invention, the high-pressure space 36 may have a discrete storage chamber 38 for storing fuel, and the modular unit 56 may project into this storage chamber 38; the housing 18 of the fuel injection valve 10 may carry a nozzle body 30 having an injection valve seat 122, which is connected to the high-pressure space 36 and with which an injection valve member 120 may be arranged in a way to be adjustable in the direction of the longitudinal axis 28, wherein a closing spring 128 may be supported on the injection valve member 120 and may subject the latter to a closing force directed in a direction toward the injection valve seat 122, there being in the housing 18 a hydraulic control device 132 controlled by an electrically controlled actuator 118 for the purpose of raising the injection valve member 120 from the injection valve seat 122 against the closing force of the closing spring 128 in order to inject fuel; and the housing 18 may have, on one hand, a valve housing 154 which carries the nozzle body 30 and in which the injection valve member 120, the closing spring 128, the actuator 118 and the control device 132 are arranged and on which a conical contact pressure surface 162 acting as a sealing surface is formed, and, on the other hand, may have a pressure connection piece 158, on the connection piece housing 156 of which the high-pressure inlet 34 is formed and the longitudinal axis 158' of which extends transversely, preferably at right angles, to the longitudinal axis 28 of the valve housing 154, wherein the connection piece housing 156 may have, in an end region remote from the high-pressure inlet 34, a conical mating contact pressure surface 164, which rests sealingly on the contact pressure surface 162, and, if appropriate, the modular unit 56 may be inserted into the connection piece housing 156 and, if appropriate, the discrete storage chamber 20 being formed at least partially in the connection piece housing 156.

According to another aspect of the invention, one of, the housing 18 or the connection piece housing 156 may have a high-pressure outlet 172, which is arranged next to the high-pressure inlet 34 and is fluidically connected, preferably without restriction, to the high-pressure inlet 34 in order to supply a further injection valve 10 with fuel via a high-pressure connecting line 176 connected to the high-pressure outlet 172.

According to a further embodiment of the invention, there is disclosed a device for intermittently injecting high-pressure fuel into the combustion chamber of an internal combustion engine. The device has a fuel injection valve 10, which has a housing 18 that has a high-pressure inlet 34, a recess 40 and a high-pressure space 36, having a valve carrier 46. The valve carrier has a fuel passage 76, having a check valve 48. The check valve allows flow of the fuel from the high-pressure inlet 34 through the fuel passage 76 into the high-pressure space 36 with as little hindrance as possible and at least restricts the flow in the opposite direction, having a feed line 16 for feeding fuel to the fuel injection valve 10, and having a fastening element 74, which loads the feed line 16 in a direction toward the high-pressure inlet 34. The valve carrier 46 is formed as a self-contained, cartridge-type modular unit 56 together with the check valve 48. A holding element 50 is fastened on the valve carrier 46 and is inserted into the recess 40 of the housing 18.

According to other aspects of the invention, the modular unit 56 may be inserted into the recess 40 from the direction of the high-pressure inlet 34; the holding element 50 may have a further fuel passage 90; the modular unit 56 may have a filter 52 for the fuel, in particular a cup-shaped filter body 52' with microholes 54, which is carried by the holding element 50 and to which the fuel flows, if appropriate through the further fuel passage 90; the recess forms at least part of the high-pressure space 36, and the modular unit 56 is inserted into the high-pressure space 36; an annular check valve seat 80 of the check valve 48 is formed on the valve carrier 46, and a check valve member 84 interacting with the check valve seat 48, preferably designed as a valve plate 84' and provided with a restrictor passage 86, is arranged between the valve carrier 46 and the holding element 50; the check valve member 84 designed as a valve plate 84' has at least one aperture 92 open in a direction radially toward the outside and passing through in the direction of the longitudinal axis 28—preferably three such apertures 92 distributed in the circumferential direction—and the holding element 50 has, in its end region adjacent to the valve plate 84', at least one groove open in a direction toward the valve plate 84' and passing through in a radial direction—preferably three such grooves 96 distributed in the circumferential direction—in order to allow flow of the fuel with as little hindrance as possible when the check valve 48 is open.

Further, according to other aspects of the invention, the high-pressure inlet 34 has a conical sealing surface 44, the valve carrier 46 has a conical outer sealing surface 60 on an outer circumferential surface 58, which sealing surface rests sealingly on the conical sealing surface 44 of the high-pressure inlet 34, the valve carrier 46 has an inner cone 68 at an inlet end 66, which inner cone forms a sealing surface and is adjoined by the fuel passage 76, the feed line 16 has an outer cone 72 in its end region adjacent to the fuel injection valve 10, said outer cone forming a sealing surface which rests sealingly on the inner cone 68 of the valve carrier 46, and the fastening element 74 presses the feed line 16 against the valve carrier 46 and presses the latter against the high-pressure inlet 34; the conical outer sealing surface 60 and the inner cone 68 are formed on a funnel-shaped end flange 62 of the valve carrier 46; the conical sealing surface 44 of the high-pressure inlet 34 is formed on the housing 18.

In accordance with other aspects of the invention, there is a cone angle difference α; β of 0.5° to 2° between the conical sealing surface 44 of the high-pressure inlet 34 and the conical outer sealing surface 60 of the valve carrier 46, on the one hand, and between the inner cone 68 of the valve carrier 46 and the outer cone 72 of the feed line 16, on the other hand, with the result that an annular sealing surface 64 is formed in each case at the smallest diameter of the contact surface between the respective tapers 44, 60; 68, 72; the high-pressure space 36 has a discrete storage chamber 38 for storing fuel, and the modular unit 56 preferably projects into this storage chamber 38; the housing 18 of the fuel injection valve 10 carries a nozzle body 30 having an injection valve seat 122, which is connected to the high-pressure space 36 and with which an injection valve member 120 arranged in such a way as to be adjustable in the direction of the longitudinal axis 28 interacts, wherein a closing spring 128 is supported on the injection valve member 120 and subjects the latter to a closing force directed in a direction toward the injection valve seat 122, and there is in the housing 18 a hydraulic control device 132 controlled by means of an electrically controlled actuator 118 for the purpose of raising the injection valve member 120 from the injection valve seat 122 against the closing force of the closing spring 128 in order to inject fuel.

According to yet other aspects of the invention, the housing 18 has, on the one hand, a valve housing 154, which carries the nozzle body 30 and in which the injection valve member 120, the closing spring 128, the actuator 118 and the control device 132 are arranged and on which a conical contact pressure surface 162 acting as a sealing surface is formed, and, on the other hand, has a pressure connection piece 158, on the connection piece housing 156 of which the high-pressure inlet 34 is formed and the longitudinal axis 158' of which extends transversely, preferably at right angles, to the longitudinal axis 28 of the valve housing 154, wherein the connection piece housing 156 has, in an end region remote from the high-pressure inlet 34, a conical mating contact pressure surface 164, which rests sealingly on the contact pressure surface 162, and, if appropriate, the modular unit is inserted into the connection piece housing 156 and, if appropriate, the discrete storage chamber 20 is formed at least partially in the connection piece housing 156.

In accordance with other aspects of the invention, the housing 18 or the connection piece housing 156 has a high-pressure outlet 172, which is arranged next to the high-pressure inlet 34 and is fluidically connected, preferably without restriction, to the high-pressure inlet 34 in order to supply a further injection valve 10 with fuel via a high-pressure connecting line 176 connected to the high-pressure outlet 172; the valve carrier 46 has, between the inner cone 68 and the check valve 48, a radial outlet 190, which starts from the fuel passage 76 and which is fluidically connected to the high-pressure outlet 34 via a connecting line 176 in the housing 18 or the connection piece housing 156; and the valve carrier 46 together with the housing 18 or the connection piece housing 156 delimits a narrow gap 102 downstream of the radial outlet 190, in a direction toward the high-pressure space 36, in order to hydraulically separate the high-pressure space 36 or, if appropriate, the discrete storage chamber 38 from the connecting line 176, at least for transient processes.

The invention claimed is:

1. A device for intermittently injecting high-pressure fuel into a combustion chamber of an internal combustion engine, having a fuel injection valve which has a housing that has a high-pressure inlet, a recess and a high-pressure space, having a valve carrier which has a fuel passage, having a check valve, which allows flow of the fuel from the high-pressure inlet through the fuel passage into the high-pressure space with as little hindrance as possible and at least restricts said flow in the opposite direction, having a feed line for feeding fuel to the fuel injection valve, and having a fastening element which loads the feed line in a direction toward the high-pressure inlet, wherein the high-pressure inlet has a conical sealing surface, the valve carrier has a conical outer sealing surface on an outer circumferential surface, which sealing surface rests sealingly on the conical sealing surface of the high-pressure inlet, and the fastening element presses the feed line against the valve carrier, and presses the latter against the high-pressure inlet.

2. The device as claimed in claim 1, wherein the valve carrier has an inner cone at an inlet end, which inner cone forms a sealing surface and is adjoined by the fuel passage, and the feed line has an outer cone in its end region adjacent to the fuel injection valve, said outer cone forming a sealing surface which rests sealingly on the inner cone of the valve carrier.

3. The device as claimed in claim 2, wherein the conical outer sealing surface and the inner cone are formed on a funnel-shaped end flange of the valve carrier.

4. The device as claimed in claim 2, wherein a cone angle difference (α, β) of 0.5° to 2° between the conical sealing surface of the high-pressure inlet and the conical outer sealing surface of the valve carrier, on the one hand, and between the inner cone of the valve carrier and the outer cone of the feed line, on the other hand, with the result that an annular sealing surface is formed in each case at the smallest diameter of the contact surface between the respective cones.

5. The device as claimed in claim 3, wherein a cone angle difference (α, β) of 0.5° to 2° between the conical sealing surface of the high-pressure inlet and the conical outer sealing surface of the valve carrier, on the one hand, and between the inner cone of the valve carrier and the outer cone of the feed line, on the other hand, with the result that an annular sealing surface is formed in each case at the smallest diameter of the contact surface between the respective cones.

6. The device as claimed in claim 1, wherein the conical sealing surface of the high-pressure inlet is formed on the housing.

7. The device as claimed in claim 1, wherein the valve carrier is formed as a self-contained, cartridge-type modular unit together with the check valve and a holding element fastened on the valve carrier and is inserted as such into the recess of the housing.

8. The device as claimed in claim 7, wherein the modular unit is inserted into the recess from the direction of the high-pressure inlet.

9. The device as claimed in claim 7, wherein the holding element has a further fuel passage.

10. The device as claimed in claim 8, wherein the holding element has a further fuel passage.

11. The device as claimed in claim 7, wherein the modular unit has a filter for the fuel, the filter comprising a cup-shaped filter body with microholes or a rod-type filter which is carried by the holding element and to which the fuel flows, if appropriate through the further fuel passage.

12. The device as claimed in claim 7, wherein the recess forms at least part of the high-pressure space, and the modular unit is inserted into the high-pressure space.

13. The device as claimed in claim 7, wherein an annular check valve seat of the check valve is formed on the valve carrier, and a check valve member interacting with the check valve seat, designed as a valve plate and provided with a restrictor passage, is arranged between the valve carrier and the holding element.

14. The device as claimed in claim 13, wherein the check valve member designed as a valve plate has at least one aperture open in a direction radially toward the outside and passing through in the direction of the longitudinal axis, said at least one aperture comprising three apertures distributed in the circumferential direction—and the holding element has, in its end region adjacent to the valve plate, at least one groove open in a direction toward the valve plate and passing in a radial direction through three grooves distributed in the circumferential direction—in order to allow flow of the fuel with as little hindrance as possible when the check valve is open.

15. The device as claimed in claim 1, wherein the high-pressure space has a discrete storage chamber for storing fuel, and the modular unit preferably projects into this storage chamber.

16. The device as claimed in claim 1, wherein the housing of the fuel injection valve carries a nozzle body having an injection valve seat, which is connected to the high-pressure space and with which an injection valve member arranged in a way to be adjustable in the direction of the longitudinal axis interacts, wherein a closing spring is supported on the injection valve member and subjects the latter to a closing force directed in a direction toward the injection valve seat, and there is in the housing a hydraulic control device controlled by an electrically controlled actuator for the purpose of raising the injection valve member from the injection valve seat against the closing force of the closing spring in order to inject fuel.

17. The device as claimed in claim 16, wherein the housing has, on the one hand, a valve housing which carries the nozzle body and in which the injection valve member, the closing spring, the actuator and the control device are arranged and on which a conical contact pressure surface acting as a sealing surface is formed, and, on the other hand, has a pressure connection piece, on the connection piece housing of which the high-pressure inlet is formed and the longitudinal axis of which extends transversely, at right angles, to the longitudinal axis of the valve housing, wherein the connection piece housing has, in an end region remote from the high-pressure inlet, a conical mating contact pressure surface, which rests sealingly on the contact pressure surface, and, the modular unit is inserted into the connection piece housing and, the discrete storage chamber is formed at least partially in the connection piece housing.

18. The device as claimed in claim 1, wherein one of, the housing or the connection piece housing has a high-pressure outlet which is arranged next to the high-pressure inlet and is fluidically connected, without restriction, to the high-pressure inlet in order to supply a further injection valve with fuel via a high-pressure connecting line connected to the high-pressure outlet.

19. The device as claimed in claim 2, wherein the valve carrier has, between the inner cone and the check valve, a radial outlet, which starts from the fuel passage and which is fluidically connected to the high-pressure outlet via a connecting line in one of, the housing or the connection piece housing.

20. The device as claimed in claim 18, wherein the valve carrier has, between the inner cone and the check valve, a radial outlet which starts from the fuel passage and which is fluidically connected to the high-pressure outlet via a connecting line in one of, the housing or the connection piece housing.

21. The device as claimed in claim 19, wherein the valve carrier together with one of, the housing or the connection piece housing, delimits a narrow gap downstream of the radial outlet, in a direction toward the high-pressure space in order to hydraulically separate one of, the high-pressure space or, the discrete storage chamber from the connecting line, at least for transient processes.

22. The device as claimed in claim 20, wherein the valve carrier together with one of, the housing or the connection piece housing delimits a narrow gap downstream of the radial outlet, in a direction toward the high-pressure space, in order to hydraulically separate one of, the high-pressure space or, the discrete storage chamber from the connecting line, at least for transient processes.

23. A device for intermittently injecting high-pressure fuel into a combustion chamber of an internal combustion engine, having a fuel injection valve, which has a housing that has a high-pressure inlet, a recess and a high-pressure space having a valve carrier which has a fuel passage having a check valve which allows flow of the fuel from the high-pressure inlet through the fuel passage into the high-pressure space with as little hindrance as possible and at least restricts said flow in the opposite direction, having a feed line for feeding fuel to the fuel injection valve, and having a fastening element which loads the feed line in a direction toward the high-pressure inlet, wherein the high-pressure inlet has an annular sealing surface which is situated in a sealing plane, the valve carrier has, in a step-type narrowing, an annular outer sealing surface, which is situated in the sealing plane and rests sealingly on the annular sealing surface of the high-pressure inlet, and (i) the fastening element presses the feed line against the valve carrier and presses the latter against the high-pressure inlet, or (ii) the fastening element presses the feed line against an intermediate connection piece having a through feed bore for the fuel, and said connection piece presses the valve carrier against the high-pressure inlet.

24. A device for intermittently injecting high-pressure fuel into a combustion chamber of an internal combustion engine, having a fuel injection valve which has a housing that has a high-pressure inlet, a recess and a high-pressure space, having a valve carrier which has a fuel passage, having a check valve, which allows flow of the fuel from the high-pressure inlet through the fuel passage into the high-pressure space with as little hindrance as possible and at least restricts said flow in the opposite direction, having a feed line for feeding fuel to the fuel injection valve, and having a fastening element which loads the feed line in a direction toward the high-pressure inlet, wherein the high-pressure inlet has a conical sealing surface, the valve carrier has a conical outer sealing surface on an outer circumferential surface, which sealing surface rests sealingly on the conical sealing surface of the high-pressure inlet, the fastening element presses the feed line against an intermediate connection piece fastened on the housing and having a through feed bore for the fuel, and said connection piece presses the valve carrier against the high-pressure inlet.

25. A device for intermittently injecting high-pressure fuel into a combustion chamber of an internal combustion engine, having a fuel injection valve, which has a housing that has a high-pressure inlet, a recess and a high-pressure space, having a valve carrier which has a fuel passage, having a check valve which allows flow of fuel from the high-pressure inlet through the fuel passage into the high-pressure space with as little hindrance as possible and at least restricts said flow in the opposite direction, having a feed line for feeding fuel to the fuel injection valve, and having a fastening element which loads the feed line in a direction toward the high-pressure inlet, wherein the high-pressure inlet has a conical sealing surface, the valve carrier having on an outer circumferential surface, a conical outer sealing surface and a thread, the valve carrier being screwed by its thread into a mating thread of the housing, with the result that the conical outer sealing surface rests sealingly on the conical sealing surface of the high-pressure inlet, and the fastening element presses the feed line against the valve carrier.

26. The device as claimed in claim 25, wherein the fastening element is designed as a screw and is screwed into the mating thread.

* * * * *